United States Patent [19]

Ishida et al.

[11] Patent Number: 4,694,999

[45] Date of Patent: Sep. 22, 1987

[54] TOROIDAL WINDING APPARATUS

[75] Inventors: Masahiro Ishida; Shunichi Kato; Noboru Takasu, all of Yokohama, Japan

[73] Assignee: Kabushiki Kaisha Toshiba, Kawasaki, Japan

[21] Appl. No.: 798,025

[22] Filed: Nov. 14, 1985

Related U.S. Application Data

[62] Division of Ser. No. 633,888, Jul. 24, 1984, Pat. No. 4,568,032.

[30] Foreign Application Priority Data

| | | | |
|---|---|---|---|
| Jul. 26, 1983 | [JP] | Japan | 58-135176 |
| Aug. 23, 1983 | [JP] | Japan | 58-152436 |
| Sep. 17, 1983 | [JP] | Japan | 58-170598 |
| Oct. 19, 1983 | [JP] | Japan | 58-194032 |
| Oct. 25, 1983 | [JP] | Japan | 58-199484 |
| Oct. 31, 1983 | [JP] | Japan | 58-203836 |
| May 8, 1984 | [JP] | Japan | 59-91224 |
| May 8, 1984 | [JP] | Japan | 59-91225 |
| May 8, 1984 | [JP] | Japan | 59-91226 |

[51] Int. Cl.[4] ..... H01F 41/08

[52] U.S. Cl. ..... 242/4 R

[58] Field of Search ..... 242/4 R, 4 B, 4 C; 29/605

[56] References Cited

U.S. PATENT DOCUMENTS

| | | | |
|---|---|---|---|
| 2,891,735 | 6/1959 | Muller | 242/4 R |
| 2,962,235 | 11/1960 | Ridler et al. | 242/4 R |
| 3,128,955 | 4/1964 | Stutz | 242/4 R |
| 3,239,153 | 3/1966 | Halacsy | 242/4 R |
| 3,967,786 | 7/1976 | Ivanoy | 242/4 R |
| 3,985,310 | 10/1976 | Kent et al. | 242/4 R |
| 4,184,644 | 1/1980 | Itoh et al. | 242/4 R |
| 4,269,366 | 5/1981 | Lindenmeyer | 242/4 R |
| 4,288,041 | 9/1981 | Marzec et al. | 242/4 R |
| 4,424,939 | 1/1984 | Ohashi | 242/4 R |

FOREIGN PATENT DOCUMENTS

| | | |
|---|---|---|
| 55-153308 | 11/1980 | Japan . |
| 56-85811 | 7/1981 | Japan . |
| 56-148812 | 11/1981 | Japan . |
| 57-111011 | 7/1982 | Japan . |

*Primary Examiner*—Billy S. Taylor

*Attorney, Agent, or Firm*—Cushman, Darby & Cushman

[57] ABSTRACT

A winding apparatus has a rotating unit on which a video head having a through hole is mounted. A wire is fed through the through hole and drawn taut. The video head is pivoted 180° by the rotating unit so that the wire stretched is wound around the head. Then, a first wire feeding unit clamps the end portion of the wire, is pivoted 180° and moved to the vicinity of the head to direct the end of the wire to the through hole. Thereafter, the first feeding unit feeds the wire trough the through hole from one end thereof, and the wire is stretched thereby winding the wire around the head. The head is then pivoted 180° by the rotating unit to wind the wire around the head. Thereafter, a second wire feeding unit clamps the end portion of the wire and is pivoted 180° and moved to the vicinity of the head to direct the end of the wire to the through hole. The second feeding unit then feeds the wire through the through hole. Thereafter, the apparatus is continually driven in the above steps.

24 Claims, 85 Drawing Figures

FIG. 22
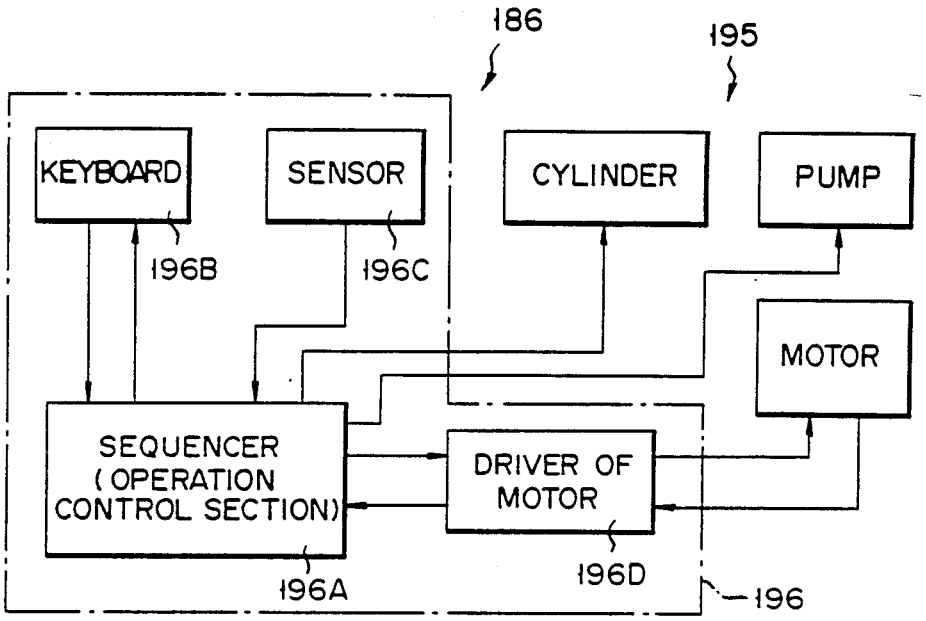
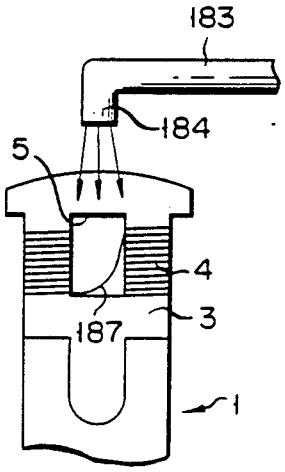
FIG. 23K

TOROIDAL WINDING APPARATUS

This is a division of application Ser. No. 633,888, filed July 24, 1984, now U.S. Pat. No. 4,568,032.

BACKGROUND OF THE INVENTION

The present invention relates to a winding apparatus for winding a wire around an object with a small through hole by passing the wire through this through hole.

In the manufacture of the video head 1 shown in FIG. 1, a wire 4 must be wound at a portion of a head chip 3 to form a magnetic circuit at such a portion. The head chip 3 as an object to be wound is mounted at the distal end of a projection 2 of the video head 1. A square hole 5 having a very small side of about several hundred micrometers is formed in the head chip 3. The wire 4 has a very small diameter of several tens of micrometers and has a low rigidity. The wire 4 is passed through the square hole 5 and is wound a multiple of ten times around that portion of the head chip 3 which a magnetic circuit must be formed.

This winding operation of the wire 4 is conventionally performed manually, so that the working efficiency has been very low. Since the work involves the minute operation of passing a thin wire through a small square hole 5, the worker must concentrate and be careful, resulting in fatigue. Therefore, as the working hours pass, the working efficiency is lowered, and errors tend to occur more frequently.

SUMMARY OF THE INVENTION

The present invention has been made in consideration of this and has as its object to provide a winding apparatus for automatically winding a wire around an object with a through hole by passing the wire through this through hole.

According to an aspect of the present invention, a winding apparatus comprises a base;

holding means, arranged on the base, for holding an object to be wound to be rotatable about an axis perpendicular to an axis of a through hole of said object between a first position and a second position which are separated by 180°;

wire supply means, arranged on the base to be movable toward and away from said object held by said holding means, for supplying the wire through the through hole from one end thereof by a predetermined length;

first and second wire feeding means, opposed to each other with the holding means interposed therebetween, for clamping a leading end of the wire supplied through the through hole and feeding the wire through the through hole from one end thereof, each of said first and second wire feeding means being arranged on the base to be movable between a front position adjacent to the object and a rear position separated from the object and being rotatable about the axis perpendicular to the axis of the through hole;

first and second suction means, opposed to each other with said holding means interposed therebetween, for drawing by suction the wire passed through said through hole from one end thereof so as to render the wire taut, each of said first and second suction means being movable between a front position adjacent to the object and a rear position separated from the object; and drive means for driving the supply means to supply a wire from one end of the through hole of the object held by the holding means, moving the first suction means located at the other end side of the through hole to its front position to draw by suction the wire supplied thereto, moving the first suction means to its rear position to render the wire taut, and thereafter moving the holding means from the first position to the second position to wind the wire around the object;

driving the first feeding means located at the same side as said first suction means with respect to the holding means so as to clamp the leading end portion of the wire, and thereafter pivoting the first feeding means by 180° and moving the first feeding means to the front position thereof to face the leading end of the wire to the through hole;

driving the first feeding means so as to feed the wire through the through hole, moving the second suction means to the front position thereof to draw the wire by suction, thereafter moving the second suction means to the rear position thereof to render the wire taut, and pivoting the holding means to the first position thereof to wind the wire around the object;

driving the second feeding means so as to clamp the leading end portion of the wire, and thereafter pivoting the second feeding means through 180° and moving the second feeding means to the front position thereof;

driving the second feeding means to feed the wire through the through hole; and thereafter continually driving the first suction means and the first feeding means, the second suction means and the second feeding means, and the holding means in the above steps.

In this manner, the winding apparatus of the present invention can automatically wind wire on an object. When the winding apparatus of the present invention is used in winding operation of a wire around a head chip of a video head, for example, the working efficiency can be improved significantly. With this, the load of the worker can be reduced, and the production of defective head chips can be reduced.

BRIEF DESCRIPTION OF THE DRAWINGS

FIGS. 2 to 23K show a winding apparatus according to an embodiment of the present invention, in which:

FIG. 2 is a perspective view schematically showing the overall winding apparatus, FIG. 3 is a longitudinal sectional view of a holding means, FIG. 4 is a front view of an upper portion of the holding means, FIG. 5 is a perspective view of the upper portion of the holding means, FIGS. 6 and 7 are, respectively, a partially broken away side view and a rear view of a wire supplying means, FIGS. 8 to 10 are a perspective view of the wire supplying means, a side view of the same from a different side from that in FIG. 6, and a sectional view of the same along line A—A in FIG. 9, respectively, FIG. 11 is a sectional view along line A'—A' in FIG. 9, FIG. 12 is a plan view of wire feeding means and suction means, FIGS. 13 and 14 are a side view and a front view of the wire feeding means and the suction means, respectively, FIGS. 15 to 17 are respectively a plan view of the wire feeding means, a side view of the same, and a sectional view of the same along line B—B in FIG. 16, FIGS. 18 and 19 are schematic views showing a clamping mechanism of the wire feeding means in the open and closed states, respectively, FIGS. 20 and 21 are a plan view and a side view of the suction means, FIG. 22 is a block diagram of drive means, and FIGS. 23A to 23K are views schematically showing the operation steps of the winding apparatus;

FIGS. 24 to 30 show a winding apparatus according to a second embodiment of the present invention, in which:

FIG. 24 is a perspective view schematically showing the overall winding apparatus, FIGS. 25 to 27 are respectively a partially broken away plan views of the wire feeding means, a front view of the feeding means viewed from the direction of an arrow C in FIG. 25, and a side view of the same viewed from the direction of an arrow D in FIG. 26, FIGS. 28 and 29 are respectively a front view and a side view of holding means, and FIG. 30 is a side view of a wire suction unit;

FIGS. 31 to 34H show a winding apparatus according to a third embodiment of the present invention, in which:

FIG. 31 is a perspective view schematically showing the overall winding apparatus, FIGS. 32 and 33 are respectively a sectional view of a wire feeding unit and a sectional view of the same along line E—E in FIG. 32, and FIGS. 34A to 34H are views schematically showing the operation steps of the winding apparatus;

FIGS. 35 to 38 show a modification of the wire feeding unit, in which:

FIGS. 35 and 36 are respectively a side view of the same and a sectional view of the same along line F—F in FIG. 35, and FIGS. 37 and 38 are enlarged views of guide holes;

FIGS. 39 to 54F show a winding apparatus according to a fourth embodiment of the present invention, in which:

FIG. 39 is a perspective view schematically showing the overall winding apparatus, FIG. 40 is an enlarged side view of the main part of the winding apparatus, FIG. 41 is a front view showing a mounted structure of wire feeding means and suction means, FIG. 42 is a partially broken away plan view showing the mounted structure of the wire feeding means, FIGS. 43 to 46 show wire supplying means, in which FIG. 43 is a sectional view of a case, FIG. 44 is a partially broken away side view of the supplying means, FIG. 45 is a bottom view of the supplying means, and FIG. 46 is a sectional view along line G—G in FIG. 44, FIGS. 47 to 49 are respectively a side view of the wire feeding means, a bottom view of the same, and a sectional view along line H—H in FIG. 48, FIGS. 50 and 51 are schematic views showing a clamping mechanism of the wire feeding means in the open and closed states, respectively, FIGS. 52 and 53 are respectively a side view and a front view of suction means, and FIGS. 54A to 54F are views schematically showing the operation steps of the winding apparatus; and FIGS. 55 to 57G show a winding apparatus according to a fifth embodiment of the present invention, in which:

FIG. 55 is a perspective view schematically showing the winding apparatus,

FIG. 56 is an enlarged side view showing the main part of the apparatus, and

FIGS. 57A to 57G are views schematically showing the operation steps of the winding apparatus.

DETAILED DESCRIPTION OF THE PREFERRED EMBODIMENTS

Figure 1:
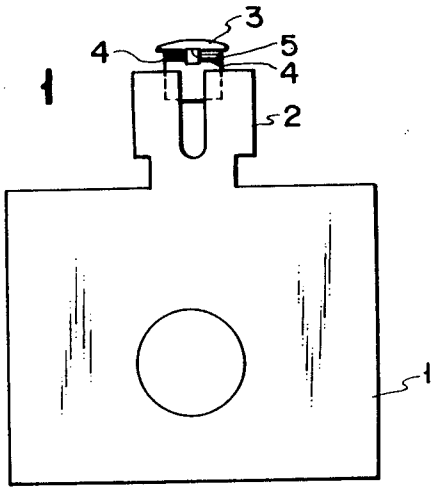
FIG. 1 is a front view showing a video head as an object on which a wire is to be wound.

The preferred embodiments of the present invention will be described with reference to the accompanying drawings.

FIGS. 2 to 22K show a winding apparatus 6 according to the first embodiment of the present invention. The winding apparatus 6 will first be described briefly with reference to FIG. 2.

The winding apparatus 6 has a substantially rectangular base 10. Holding means 11 for holding a video head 1 as an object (FIG. 1) on which wire is to be wound, and a wire supply unit 12 for supplying the wire to be wound on the video head 1 are arranged at substantially the center of the upper surface of the base 10. The holding means 11 and the wire supply unit 12 are opposite each other and are separated from each other along the width of the base 10. A guide mechanism 7 is arranged on that portion of the upper surface of the base 10 which is located between the holding means 11 and the wire supply unit 12. The guide mechanism 7 extends along the longitudinal direction of the base 10. The guide mechanism 7 guides a pair of wire feeding units 112 and 113, and a pair of wire suction units 125 and 126 such that they are movable toward and away from the holding means 11.

Figure 3:
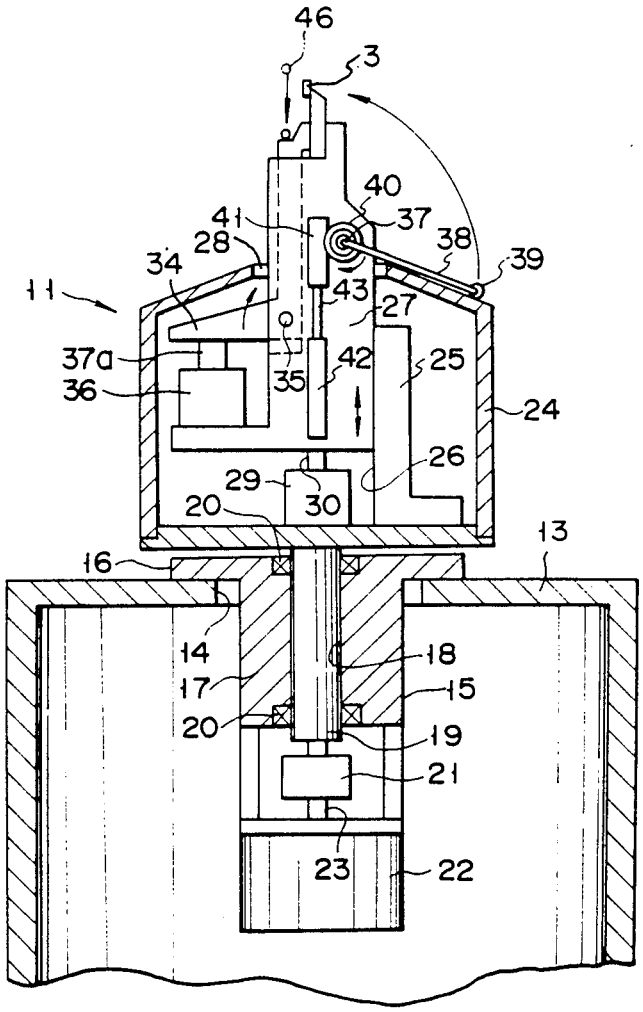
Figure 4:
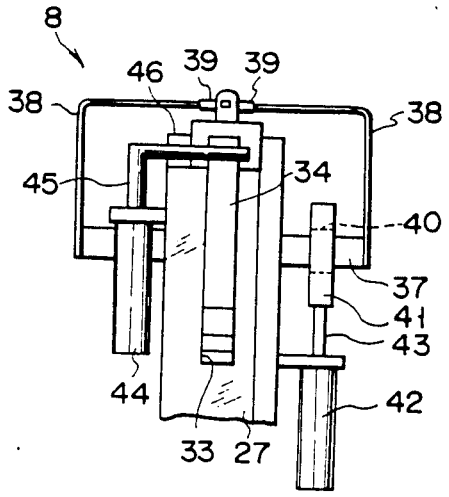
Figure 5:
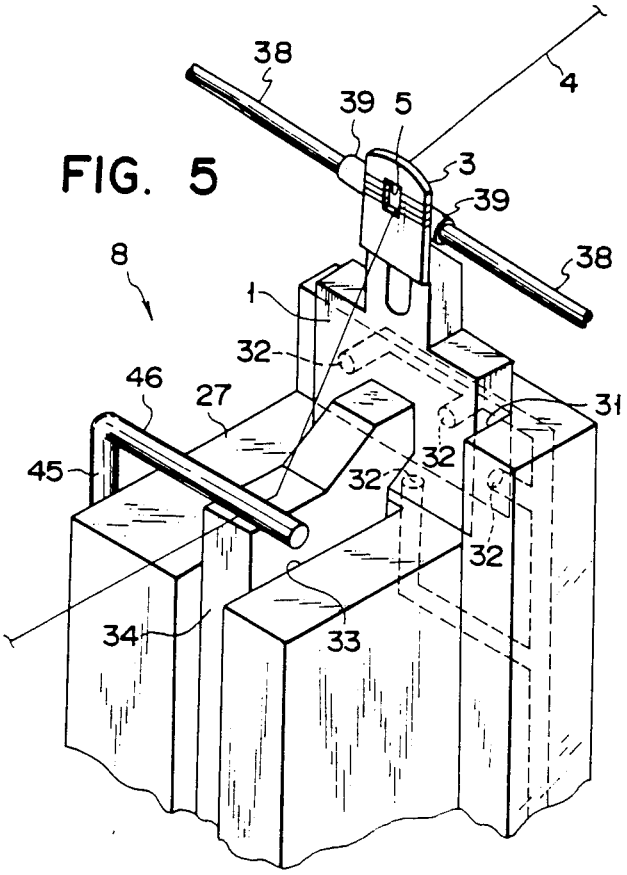

The holding means 11 has the structure as shown in FIGS. 3 to 5. The holding means 11 has a cylindrical case 13 which is fixed on the upper surface of the base 10. A hole 14 is formed in the upper wall of the case 13 to receive therein a support member 15. The support member 15 has a columnar portion 17 and a flange portion 16 formed at one end of the portion 17. The flange portion 16 is fixed and adhered to the upper surface of the upper wall of the case 13. The support member 15 may directly be mounted on the base 10. A support hole 18 is formed to extend along the entire length of the columnar portion 17. A rotating shaft 19 is rotatably supported in the support hole 18 through a bearing 20. A first motor 22 is fixed to the lower end of the columnar portion 17. A rotating shaft 23 of the motor 22 is coupled to the lower end of the rotating shaft 19 through a coupling 21. Therefore, the rotating shaft 19 is driven by the first motor 22. The lower end face of a substantially cylindrical housing 24 is fixed to the upper end of the rotating shaft 19 so as to be coaxial therewith. An L-shaped guide 25 is arranged in the housing 24 such that its guide surface 26 extends vertically. A slider 27 is also arranged in the housing 24 to be slidable along the guide surface 26 of the guide 25. The upper end of the slider 27 extends outward from a through hole 28 formed in the upper wall of the housing 24. An actuating rod 30 of a first air cylinder 29 is fixed to the lower end of the slider 27. When the air cylinder 29 is actuated and the actuating shaft 30 is moved vertically, the slider 27 is slid accordingly. A recess 31 opening in three directions of the upper end face, the front surface and one side face of the slider 27, as shown in FIG. 5, is formed in the slider 27. Suction holes 32 communicating with a vacuum pump (not shown) are opened to the respective surfaces defining the recess 31. The video head 1 shown in FIG. 1 is drawn by suction and is held in the recess 31 by means of the suction force acting through these suction holes 32. A mounting groove 33 is formed axially in the slider 27 to be open to the front and upper end face thereof. An L-shaped gripper 34 is arranged in the mounting groove 33 such that an intermediate portion thereof is pivotally supported by a pivot pin 35. An actuating rod 37*a* of a second air cylinder 36 mounted on the slider 27 is opposite one end of the gripper 34. When the second air cylinder 36 is actuated and the actuating rod 37*a* projects, the gripper 34 is pivoted clockwise (FIG. 3), and the other end thereof is urged against the video head 1 drawn into the recess 31. In this manner, the video head 1 is drawn by suction in the recess 31 and is also clamped by the gripper 34 and one side surface defining the recess 31. A rotating shaft 37 extends horizontally through the slider 27 so as to be rotatable. One end of each of L-shaped first press members 38 is fixed to a corresponding end of the rotating shaft 37. An elastic member 39 such as a rubber member is fixed to the other end of each first press member 38. A pinion 40 is coaxially mounted at one end of the rotating shaft 37. A rack 41 meshes with the pinion 40. The rack 41 is mounted on an actuating rod 43 of a third air cylinder 42 mounted on one side surface along the width of the slider 27. When the actuating shaft 43 is actuated and the rack 41 is moved downward, the pinion 40 is pivoted counterclockwise (FIG. 3) and the rotating shaft 37 is mover therewith. Then, the first press members 38 are pivoted counterclockwise, so that the elastic members 39 mounted to the corresponding ends of the members 38 are urged against the head chip 3 of the video head 1, as shown in FIG. 5. As will be described later, the wire 4 wound around the head chip 3 is held by the elastic members 39, so that the wire 4 being wound will not be loosened during the winding operation. A fourth air cylinder 44 is arranged at the other side surface of the slider 27 along the width thereof, so that its actuating rod 45 extend vertically, as shown in FIG. 4. A rod-shaped second press member 46 is fixed at one end to the actuating rod 45 and extends horizontally. The second press member 46 is normally located above the upper end of the gripper 34 gripping the video head 1, as indicated by the dotted line in FIG. 3. When the fourth air cylinder 44 is actuated, the second press member 46 is moved downward and is urged against the horizontal upper end face of the gripper 34. The trailing end of the wire, which is supplied from the wire supply unit 12 in a manner to be described later and cut to a predetermined length, is clamped between the second press member 46 and the gripper 34 and is fixed at one side of the video 1, as shown in FIG. 5. The first and second press members 38 and 46 described above partially constitute a fixing mechanism 8 according to the present invention.

The wire supply unit 12 has the structure shown in FIGS. 6 to 11. The wire supply unit 12 has a column 50 extending vertically upward on the base 10. A flat box-like case 51 is bonded to one side of the column 50. A supply reel 52 on which the wire 4 is wound is arranged on the upper surface of the column 50. The supply reel 52 is driven by a second motor 53 supported on the column 50. The wire 4 supplied from the supply reel 52 is guided into the case 51 through an inlet port 54 formed in its upper surface and is guided outside through an outlet port 55 also formed in the upper surface of the case 51. A ring weight 56 of a light material such as Al is movably housed inside the case 51. The portion of the wire 4 which is guided inside the case 51 is looped around the weight 56. The weight 56 thus applies a suitable amount of tension to the wire such that the wire 4 is kept taut and will not become entangled or twisted. First and second photosensors 57 and 58 are arranged inside the case 51 such that they are vertically spaced from each other. The photosensors 57 and 58 are electrically connected to the second motor 53. When the wire 4 is supplied from the case 51 and the weight 56 is moved upward, the first photosensor 57 detects the weight 56 and so energizes the second motor 53. Then, the supply reel 52 is rotated, and the wire 4 wound around the supply reel 52 is supplied into the case 51. As the weight 56 is moved downward, the second photosensor 58 detects the weight 56, and the second motor 53 is stopped. In this manner, the length of the wire 4 in the case 51 is kept within a predetermined range by the first and second photosensors 57 and 58 as adjusting means 9.

A support plate 59 is fixed on the upper end of the column 50 and extends horizontally toward the holding means 11. A U-shaped mount 60 is fixed at the extended end of the support plate 59. A spline shaft 61 is rotatably supported between the side walls of the mount 60. One end of a supply arm 62 of a prism-like shape is supported by the spline shaft 61. The arm 62 has a spline hole (not shown) at its one end which receives the spline shaft 61. Therefore, the arm 62 rotate together with the spline shaft 61 and is slidable along the axial direction thereof. One end of a lever 63 is fitted to one end of the spline shaft 61. A U-link 64 is pivotally supported on the other end of the lever 63 by means of a pivot shaft 65*a*. An actuating rod 66 of a pivot cylinder 65 is coupled to the U-link 64. The pivot cylinder 65 is held on a support post 67 extending upright on the support plate 59. When the pivot cylinder 65 is actuated, the distal end of the arm 62 is vertically pivoted about the spline shaft 61, as indicated by the arrow in FIG. 8. A horizontal cylinder 68 is mounted midway along the lever 63 and extends along the axial direction of the spline shaft 61. An actuating rod 69 of the horizontal cylinder 68 extends through the lever 63 and is coupled to a coupling member 70 mounted on the upper surface at the rear end portion of the arm 62. When the horizontal cylinder 68 is actuated, the arm 62 is horizontally moved along the spline shaft 61, as indicated by the arrow in FIG. 8.

Figure 11:
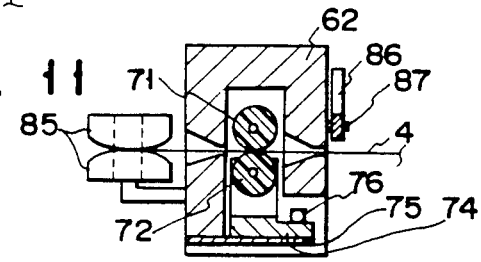

A chamber 81 is formed at the distal end portion of the arm 62 and houses therein upper and lower rollers 71 and 72 constituting a feed mechanism 188 which extend along the longitudinal direction of the arm 62. The upper roller 71 is fixed to the arm 62 and is cpoupled to a third motor 73 to be driven thereby. The lower roller 72 is rotatably supported on a U-shaped support 74. The support 74 is elastically supported by the arm 62 through a leaf spring 75 and is opposite the upper roller 71, as shown in FIG. 11. One end of an L-shaped lever 76 is fixed to the support 74. An intermediate portion of the lever 76 is pivotally supported by a pivot shaft 78 in a recess 77 formed in one side of the arm 62. An actuating rod 80 of an open/close cylinder 79 in the recess 77 is coupled to the other end of the lever 76. When the cylinder 70 is actuated and the lever 76 is pivoted as indicated by the arrow shown in FIG. 9, the support 74 is moved vertically against the leaf spring 75. When the support 74 is moved vertically, the lower roller 72 is also moved vertically. Then, the lower roller 72 comes into contact with and apart from the upper roller 71.

Figure 6:
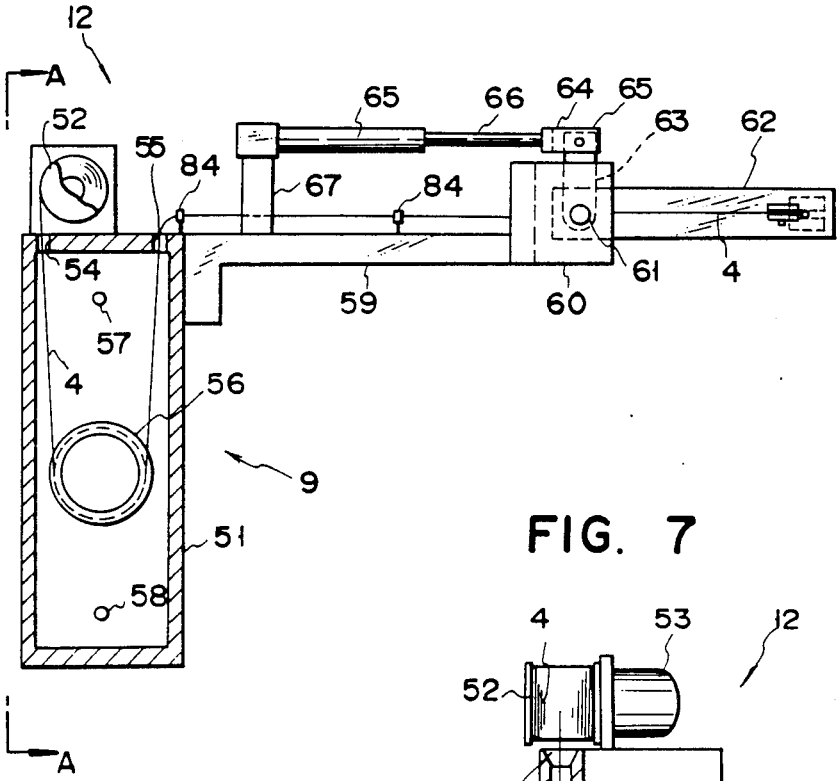
Figure 7:
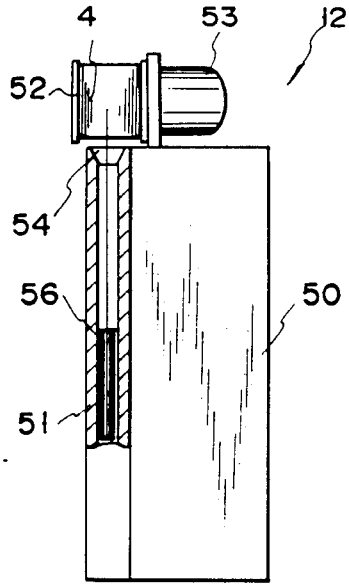
Figure 8:
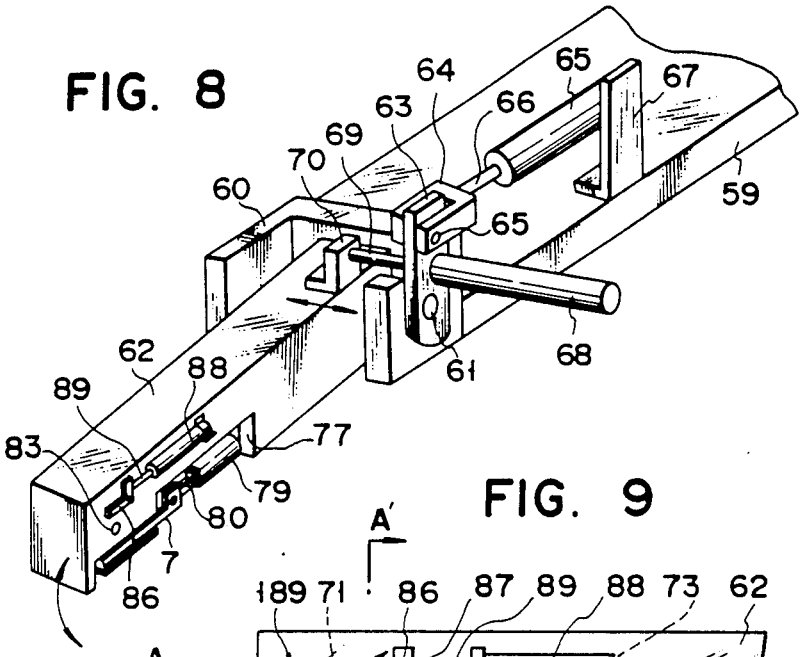
Figure 9:
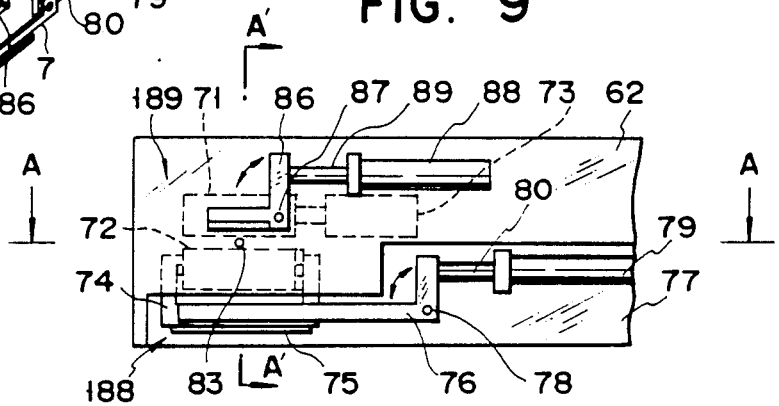
Figure 10:
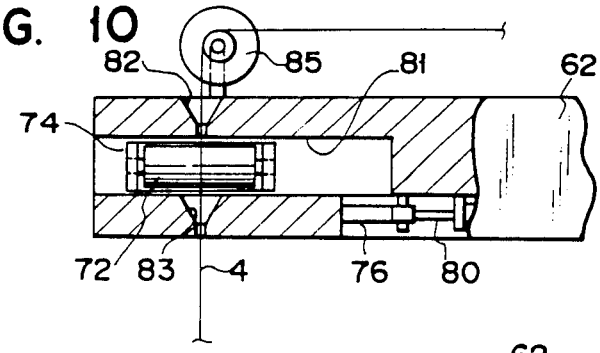

First and second guide holes 82 and 83 of a conical shape are formed at the distal end of the arm 62. The first and second guide holes 82 and 83 communicate with the chamber 81 in which the upper and lower rollers 71 and 72 are housed, as shown in FIG. 10. The holes 82 and 83 are arranged coaxially with each other and extend along a direction perpendicular to the axes of the upper and lower rollers 71 and 72. The first guide hole 82 has a smaller diameter toward the chamber 81, while the second guide hole 83 has a smaller diameter from the chamber 81 toward the outer surface of the arm 62. The wire 4 guided outside the case 51 is guided by a guide ring 84 on the support plate 59, as shown in FIG. 6. The wire 4 is guided to the position of the first guide hole 82 to be engaged with a guide roller 85, and is passed through the first guide hole 82. The wire 4 which has been passed through the first guide hole 82 is passed through the gap between the upper and lower rollers 71 and 72 and is then passed through the second guide hole 83. When the upper roller 71 is driven in a state wherein the lower roller 72 is in contact with the upper roller 71, the wire 4 is fed through the second guide hole 83.

An intermediate portion of an L-shaped cutter 86 constituting a cutter mechanism 189 is pivotally supported by a pivot shaft 87 at the side of the arm 62 to which the second guide hole 83 is open. One side of the cutter 86 is opposite the second guide hole 83, and the other side is coupled to an actuating rod 89 of a cutting cylinder 88. When the cutting cylinder 88 is actuated, the cutter 86 is pivoted to cut the wire 4 fed from the second guide hole 83.

The guide mechanism 7 on the base 10 has a pair of guide rails 90 on the upper surface of the base 10. The guide rails 90 extend parallel to each other and along the entire length of the base 10 between the holding means 11 and the wire supply unit 12. First and second tables 91 and 92 are slidably but nonrotatably guided on the guide rails 90 with guide grooves formed on their lower surfaces engaged with the guide rails 90, as shown in FIGS. 2, and 12 to 14. A pair of first supports 94*a* are erected on the upper surface of the base 10 in the vicinities of the ends of the guide rails 90. A pair of second supports 94*b* are erected on the base 10 at substantially the center of the base 10 along the longitudinal direction of the rails 90 and opposite the first supports 94*a*, respectively. Drive motors 95 are coupled to the first supports 94*a*. First and second screw shafts 96*a* and 96*b* extend between the first and second supports 94*a* and 94*b*, mesh with screw holes 97 formed in the first and second tables 91 and 92, and are coupled to the drive motors 95. When the shafts 96*a* and 96*b* are driven by the drive motors 95, the first and second tables 91 and 92 slide along the guide rails 90.

Figure 12:
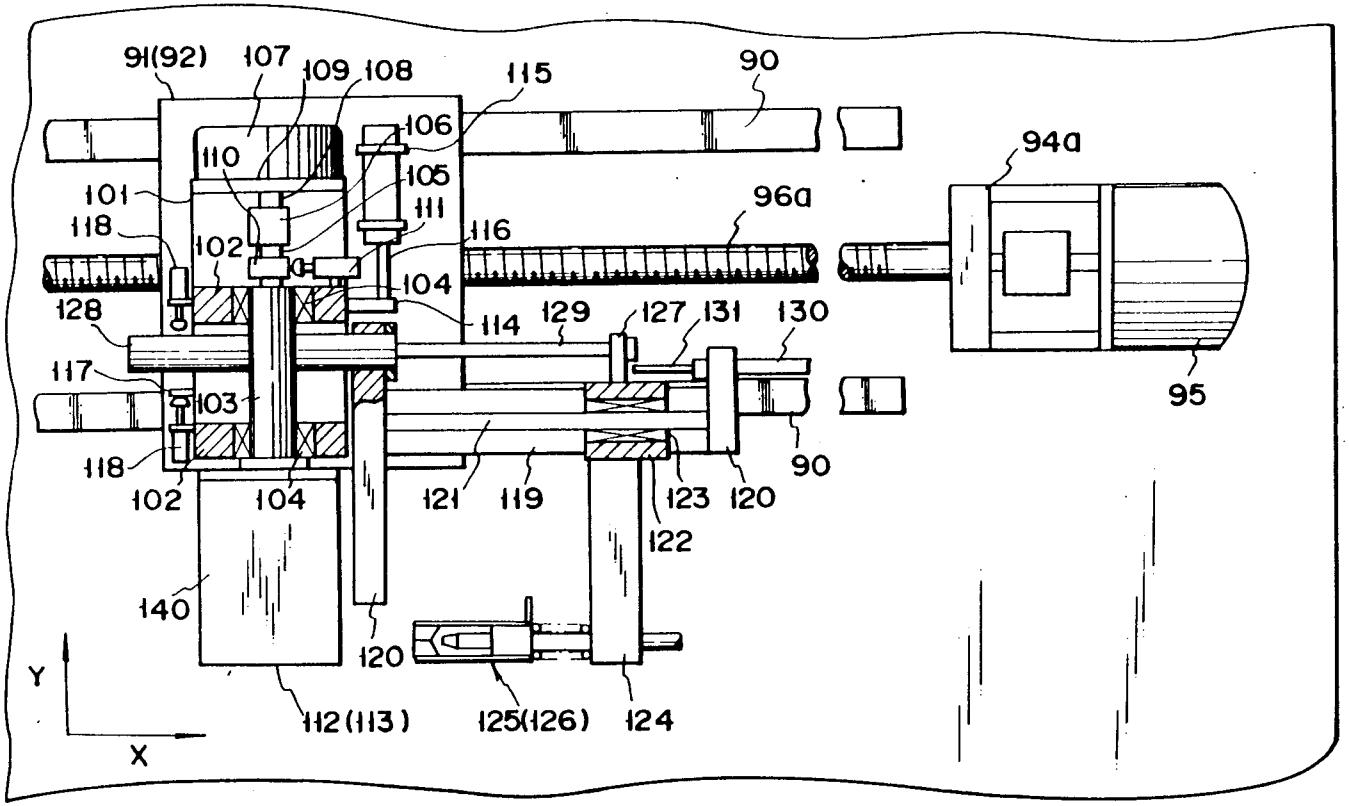
Figure 13:
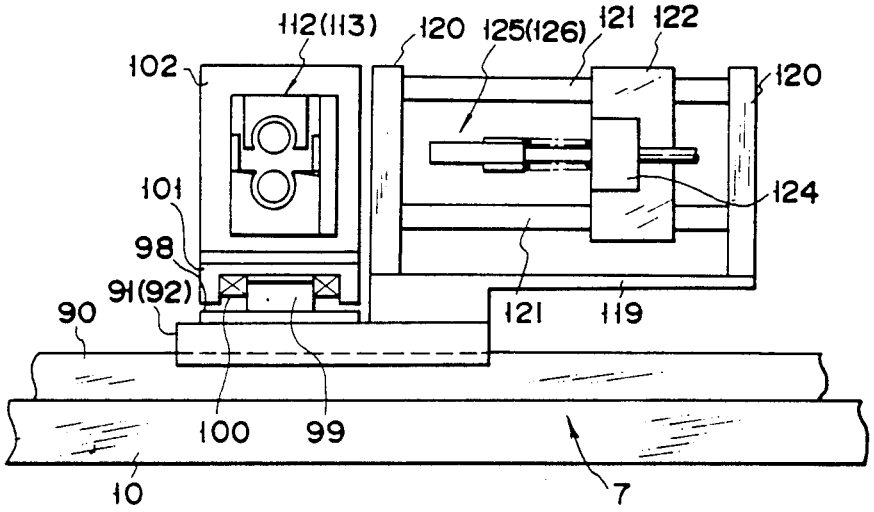
Figure 14:
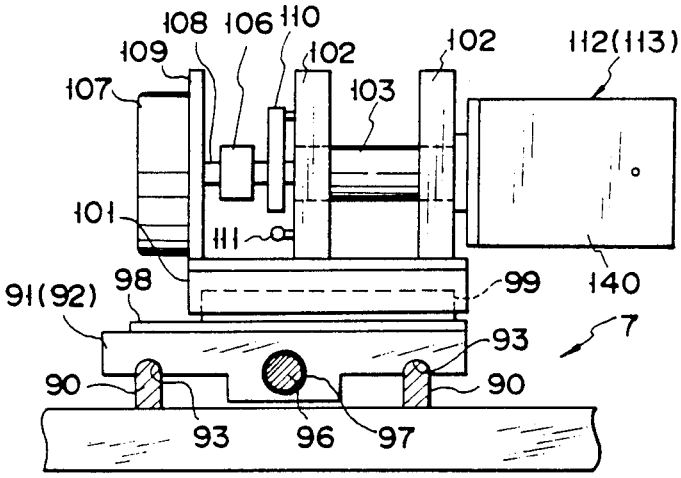
Figure 15:
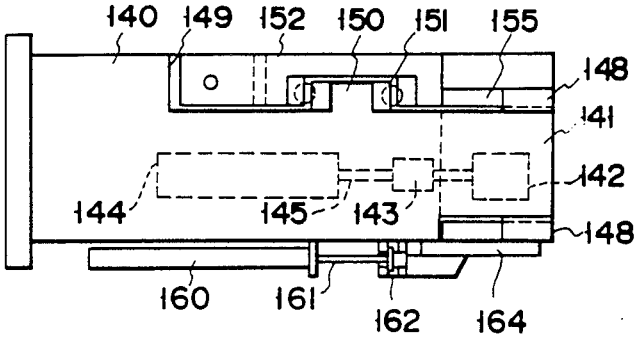
Figure 16:
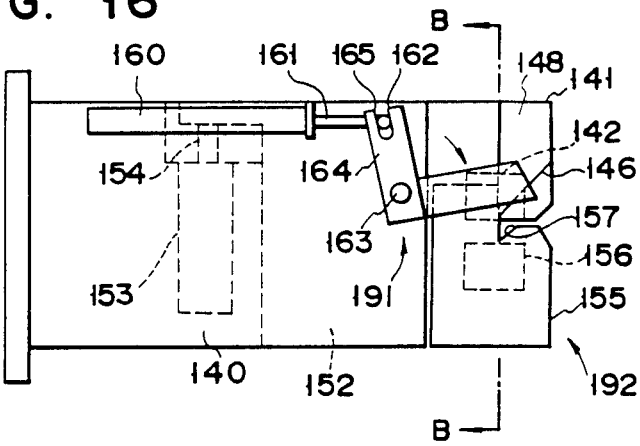
Figure 17:
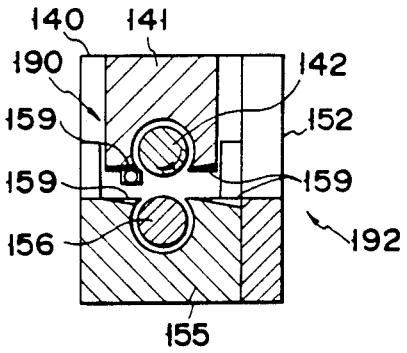

A mounting plate 98 is mounted on each table 91 or 92 to extend along a direction (referred to as the Y-direction as shown in FIG. 12) perpendicular to the guide rails 90. A prism-like slide guide 99 is arranged on each mounting plate 98 to also extend along the Y-direction. A slide plate 101 is mounted on the slide guide 99 through a bearing 100 so as to be slidable along the Y-direction. A pair of support plates 102 extend upright on the slide plate 101 along a direction (to be referred to as an X-direction) perpendicular to the Y-direction and are spaced apart from each other along the Y-direction. A mounting shaft 103 is rotatably mounted on these support plates 102 through a bearing 104 so that the axis of the shaft is aligned with the Y-direction. One end of the mount shaft 103 is formed into a smaller-diameter portion 105 extending outward from the corresponding support plate 102. The smaller-diameter portion 105 is coupled to a rotating shaft 108 of a rotating motor 107 through a coupling 106. The motor 107 is held by a mounting plate 109 mounted on the slide plate 101 opposite the support plate 102. An abutment arm 110 is mounted on the smaller-diameter portion 105. The abutment arm 110 abuts against a pair of stoppers 111 arranged on the mounting plate 109 to be vertically spaced apart from each other. The abutment arm 110 thus regulates the rotational angle of the rotating shaft 108. The rotating shaft 108 rotates within an angular interval of 180° defined by the abutment between the abutment arm 110 and the stoppers 111. A wire feeding unit to be described later is fixed on the other end of the rotating shaft 108. The wire feeding unit comprises first and second wire feeding units 112 and 113 arranged on the first and second tables 91 and 92, respectively. A coupling piece 114 is fixed to one side of the slide plate 101. An actuating rod 116 of a Y-direction cylinder 115 mounted on the first and second tables 91 and 92 is coupled to the coupling piece 114. When the Y-direction cylinder 115 is energized, the slide plate 101 and hence the wire feeding units 112 and 113 can be slid in the Y-direction. An abutment piece 117 is arranged at the other side of the slide plate 101, as shown in FIG. 12. The abutment piece 117 abuts against a pair of stoppers 118 arranged on the table 91 (92) space apart from each other along the table when the slide plate 101 slides. Thus, the sliding movement of the slide plate 101 along the Y-direction is regulated.

At the side of the mounting plate 98, one end of a horizontal plate 119 is fixed to the table 91 (92) and the horizontal plate 119 extends in the X-direction from the corresponding table 91 or 92. A pair of support plates 120 erected on the two ends of the horizontal plate 119 such that they are opposite each other. A pair of guide rods 121 are arranged between the support plates 120 and extend parallel to each other along the X-direction. A slider 122 is slidably mounted on the guide rods 121 through a bearing 123. A mounting piece 124 is fixed at its one end to the slider 122 to extend along the Y-direction. The first and second wire suction units 125 and 126 to be described later are mounted on the corresponding mounting pieces 124. A coupling piece 127 is mounted on the slider 122. An actuating rod 129 of an X-direction cylinder 128 having its axis aligned with the X-direction is coupled to the coupling piece 127. The X-direction cylinder 128 is held on one of the support plates 120. When the cylinder 128 is energized, the slider 122 is driven in the X-direction along the guide rods 121. A positioning cylinder 130 is mounted on the other support plate 120. An actuating rod 131 of the cylinder 130 extends along the X-direction and abuts against the coupling piece 127 mounted on the slider 122. The stop positions of the wire suction units 125 and 126 along the X-direction can be regulated in accordance with the projecting/withdrawing state of the actuating rod 131 of the positioning cylinder 131. One of the support plates 120 projects more toward the corresponding wire feeding unit 112 or 113 than the other.

Figure 18:
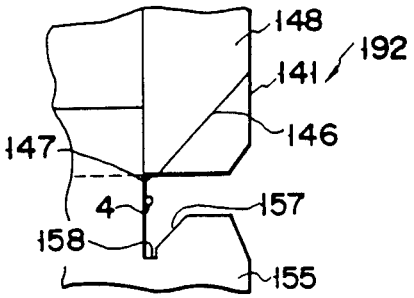
Figure 19:
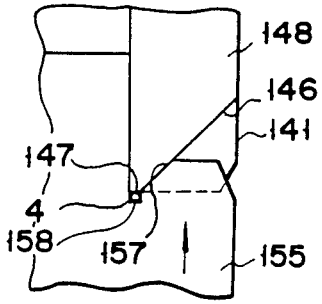

The wire feeding units 112 and 113 have the construction as shown in FIGS. 15 to 19. More specifically, the unit 112 or 113 has a block-like main body 140. An upper roller 142 constituting a feeding mechanism 190 is rotatably mounted at a distal end portion 141 of the main body 140 to extend along the longitudinal direction of the main body 140. The upper roller 142 is coupled to a rotating shaft 145 of a rotating motor 144 in the main body 140 through a coupling 143. Guide members 148 are arranged at the sides of the distal end portion 141, as shown in FIG. 18. Each guide member 148 has an inclined surface at the lower end portion and a chamfered flat surface 147 as a lower end face. A recess 149 is formed in one side surface of the main body 140. A projection 150 extending along the height of the side surface of the main body 140 is formed in the recess 149. A drive member 152 is slidably mounted on the projection 150 through a thrust bearing 151. An actuating rod 154 of an open/close cylinder 153 arranged along the direction of height of the main body 140 is coupled to one end of the drive member 152. A clamper 155 is coupled to the other end of the drive member 152 and is opposite the distal end portion 141. The clamper 155 has a substantially U-shaped section. A lower roller 156 is rotatably supported on the clamper 155 by means of a support member (not shown). The support member is elastically held by a leaf spring (not shown). An inclined surface 157 having a shape corresponding to the lower end of the guide member 148, and a groove 158 opposite the flat surface 147 of the guide member 148 are formed at the both sides of the clamper 155. When the open/close cylinder 153 is energized, the clamper 155 is driven to be moved toward or away from the distal end portion 141, that is, it is opened or closed. When the main body 140 is driven by the Y-direction cylinder 115 in the direction to be projected from the table 91 or 92 while the clamper 155 is open, the wire 4 stretched between the video head 1 on the holding means 11 and the wire suction unit 125 or 126 is guided into the gap between the distal end portion 141 and the clamper 155, as shown in FIG. 18. When the clamper 155 is moved in the closing direction indicated by the arrow shown in FIG. 19 in this state, the inclined surface 146 of the distal end portion 141 and the inclined surface 157 of the clamper 155 come into contact with each other, and wire 4 is slidably positioned in the groove 158. Then, the upper and lower rollers 142 and 156 are brought into contact with each other to clamp the wire 4. When the upper roller 142 is driven in the direction indicated by the arrow shown in FIG. 17, the wire 4 is fed in the same direction. Recesses 159 are formed at the sides of the lower end face of the distal end portion 141 and the upper end face of the clamper 155 so as to form conical through holes when the clamper 155 is closed. The through holes formed by these recesses 159 has a smaller diameter along the feeding direction of the wire 4. The distal end portion 141 and the clamper 155 constitute a clamping mechanism 192.

A cutting cylinder 160 partially constituting a cutting mechanism 191 is arranged horizontally on the side surface of the main body 140 which is opposite to the side surface in which the recess 149 is formed. An engaging pin 162 is arranged at the distal end of an actuating rod 161 of the cutting cylinder 160. The engaging pin 162 engages with a locking groove 165 formed in one side of an L-shaped cutter 164 having an intermediate portion thereof pivotally supported on the above-mentioned side surface. The other side of the cutter 164 having a blade is positioned on the side surface of the distal end portion 141. When the cutting cylinder 160 is energized and the cutter 164 is pivoted in the direction indicated by the arrow shown in FIG. 16, the wire 4 clamped by the distal end portion 141 and the clamper 155 and guided from the side surface of the main body 140 is cut by the cutter.

The wire feeding units 112 and 113 arranged on the first and second tables 91 and 92 are opposite each other with the holding means 11 interposed therebetween. When the tables 91 and 92 are driven by the drive motors 95, the respective wire feeding units are linearly reciprocated between the front position adjacent to the head chip 3 held by the holding means 11 and the rear position separated from the head chip 3.

Figure 2:
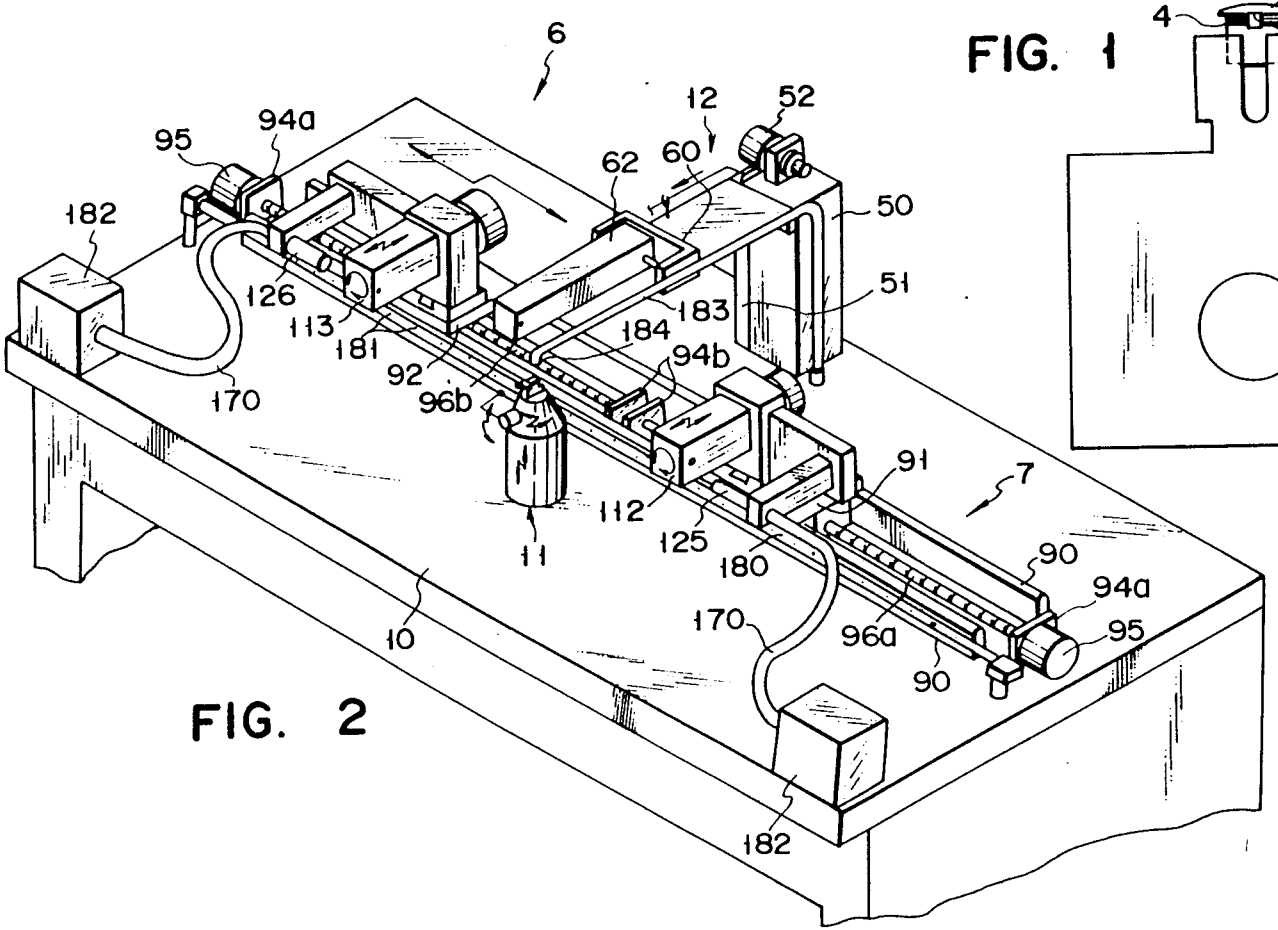
Figure 20:
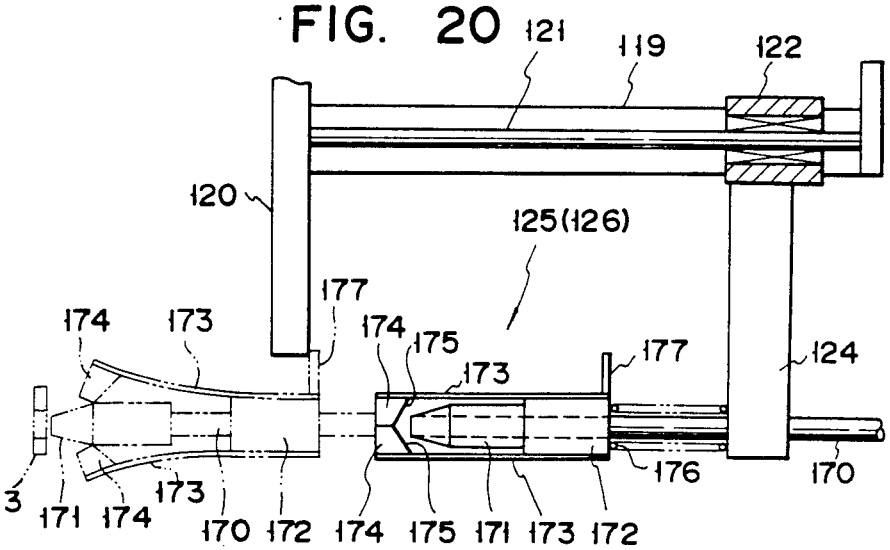
Figure 21:
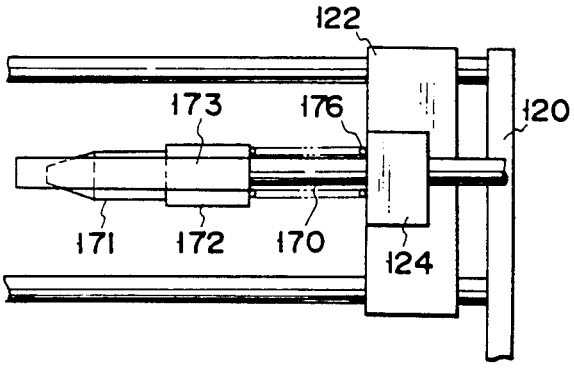

The first and second wire suction units 125 and 126 have the construction as shown in FIGS. 20 and 21. Each wire suction unit 125 or 126 has a pipe 170 which is fixed on the mounting piece 124 extending from the slider 122 and extends along the X-direction, i.e., the length of the guide rails 90. The pipe 170 is connected to a vacuum pump 182 arranged on the base 10, as shown in FIG. 2. The pumps 182 may be arranged on the corresponding tables 91 and 92. A tapered sleeve 171 is mounted at the distal end of the pipe 170 at the side of the holding means 11. A prism-like movable member 172 is mounted at that portion of the pipe 170 which is between the sleeve 171 and the mounting piece 124, such that the member 172 is slidable along the axial direction of the pipe 170. One end of each of leaf springs 173 is fixed to a corresponding vertical side surface of the movable member 172. The leaf springs 173 extend from the movable member 172 toward the holding means 11 to be parallel to the pipe 170. An elastic member 174 such as rubber member is mounted at the inner surface at the other end of each of the leaf springs 173, such that the members 174 are in contact with each other. The rear end surfaces of the elastic members 174 which are opposite the sleeve 171 are formed in the tapered surfaces 175. A compression spring 176 is mounted around that portion of the pipe 170 which is located between the mounting piece 124 and the movable member 172. The compression spring 176 biases the movable member 172 toward the sleeve 171. A locking piece 177 is mounted on the movable member 172 so as to project along the Y-direction. When the mounting piece 124 is driven to come closer to the wire feeding unit 112 or 113 by the X-direction cylinder 128 (FIG. 12), the locking piece 177 abuts against one of the support plates 120 mounted on the table 91 or 92, as indicated by the dotted line shown in FIG. 20. Then, the movement of the movable member 172 is prevented, and only the pipe 170 is moved forward. The sleeve 171 presses the leaf springs 173 to spread out them and projects foward from the space therebetween. At this time, the distal end of the sleeve 171 is opposite to the square hole 5 formed in the head chip 3 held by the holding means 11.

In this manner, the wire suction units 125 and 126 are opposite each other, having the holding means 11 interposed therebetween. Also, the wire suction units 125 and 126 are arranged movable along the longitudinal direction of the guide rails 90 between the front position adjacent to the head chip 3 held by the holding means 11 and the rear position separated from the head chip 3.

As shown in FIG. 2, a first blow pipe 180 for blowing air toward the wire 4 to prevent entanglement of the wire 4 is arranged on the base 10. The blow pipe 180 constitutes blowing means 180a. Note that the blow pipe 180 is arranged to extend along the entire length of the base 10 between the guide rails 90 and the holding means 11. The blow pipe 180 is arranged horizontally at a level slightly lower than the head chip 3 held by the holding means 11. A number of nozzles 181 for blowing compressed air toward the wire 4 are formed in the wall of the blow pipe 180. A second blow pipe 183 extends along the wire supply unit 12 to a position above the holding means 11. A nozzle 184 for blowing compressed air down onto the head chip 3 held by the holding means 11 is formed at the distal end of the second blow pipe 183.

The winding apparatus 6 further comprises drive means 186 for driving the holding means 11, the wire supply unit 12, the wire feeding units 112 and 113, and the like in accordance with a predetermined operation. The drive means 186 has a drive section 195 and a control section 196 for controlling the operation of the drive section 195. The drive section 195 includes various motors such as the first motor 22, second motor 53, and drive motor 95; various cylinders such as the air cylinder 29, the cutting cylinder 88, and the X-direction cylinder 128; and the vacuum pump 182. The control section 196 includes a sequencer 196A using, for example, a microcomputer, a keyboard 196B, a sensor 196C including the photosensors 57 and 58, and a driver 196D for the motors.

The operation of the winding apparatus 6 having the construction as described above will be described with reference to FIGS. 23A to 23K.

Figure 23A:
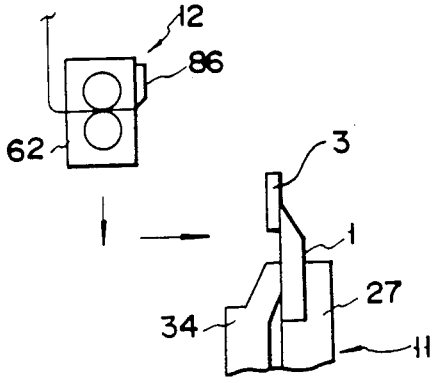
Figure 23B:
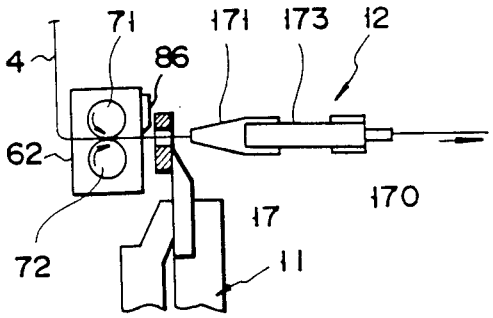
Figure 23C:
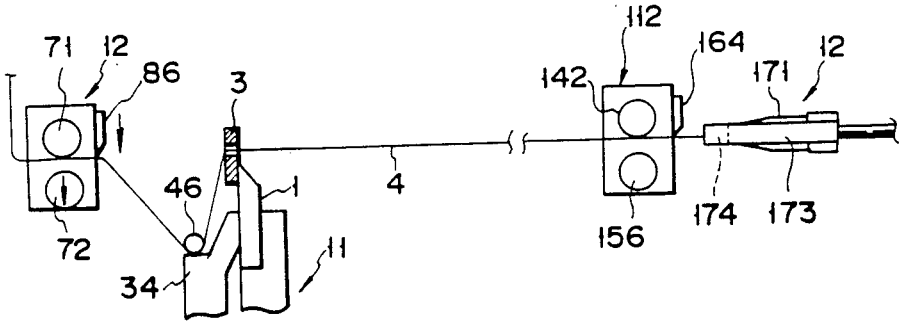

As shown in FIG. 23A, the video head 1 is set on the holding means 11 and is held by the gripper 34 and the suction force. At this time, the holding means 11 is located at its first position. In this state, the video head 1 is positioned such that the central axis of the square hole 5 formed in the head chip 3 is parallel to the guide rails 90. When the winding apparatus 6 is started in this state, the arm 62 of the wire supply unit 12 is driven by the pivot cylinder 65 and the horizontal cylinder 68 to be pivoted downward and is moved toward the holding means 11. Then, the first and second guide holes 82 and 83 formed in the arm 62 are positioned coaxially with the square hole 5 formed in the head chip 3. As the wire supply unit 12 is operated, the first table 91 is driven by the drive motor 95 and the first wire feeding unit 112 is moved to its front position, as shown in FIG. 23B. The first wire suction unit 125 is driven by the X-direction cylinder 128 to be moved to its front position, and its sleeve 171 is projected to be opposite the square hole 5 of the head chip 3. At this time, the sleeve 171 is coaxial with the square hole 5, and the first wire feeding unit 112 is in its first position and is separated from the sleeve 171. Subsequently, the vacuum pump 182 is driven to apply a suction force on the first wire suction unit 125. At the same time, the upper roller 71 in the arm 62 is driven to feed a predetermined length of the wire 4 clamped between the upper and lower rollers 71 and 72. The wire 4 supplied in this manner is drawn by suction into the pipe 170 from the sleeve 171 through the square hole 5 in the head chip 3. Then, as shown in FIG. 23C, the first wire suction unit 25 is moved to its rear position to withdraw the sleeve 171 and to clamp the wire 4 with the elastic member 174. Thereafter, the first wire feeding unit 112 is moved to its rear position together with the wire suction unit 125 so as to pull predetermined length of the wire 4 from the pipe 170 to be wound around the head chip 3. The wire 4 is suspended between the arm 62 and the sleeve 171. The rollers 71 and 72 of the arm 62 are separated from each other, and the arm 62 is moved away from the holding means 11. At the same time, the second press member 46 arranged on the holding means 11 is moved downward so as to clamp and fix in position the rear end of the wire 4 in cooperation with the upper horizontal surface of the gripper 34. Then, the cutter 86 at the side surface of the arm 62 is actuated to cut the wire 4. When the cutter 86 finishes cutting the wire 4, the arm 62 is pivoted upward.

Figure 23D:
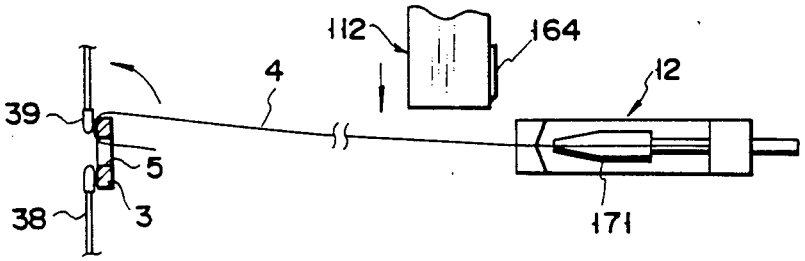
Figure 23E:
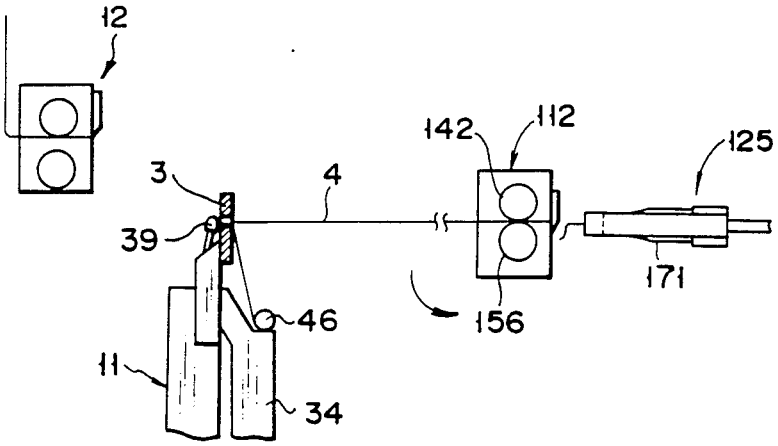
Figure 23F:
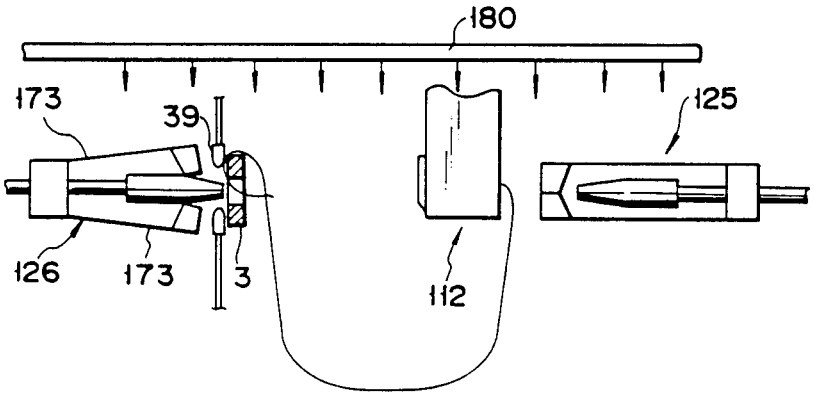

As shown in FIG. 23D, the housing 24 of the holding means 11 is pivoted counterclockwise to the second position by 180°. Thus, the wire 4 is wound once around one side of the head chip 3. When the housing 24 is at the second position, the head chip 3 is also positioned such that the central axis of the square hole 5 is parallel to the guide rails 90. When the first press member 38 of the holding means 11 is pivoted toward the head chip 3, and the elastic members 39 are urged against the two sides of the square hole 5 of the head chip 3 so as to prevent any loosening of the wire 4 wound therearound. Then, as shown in FIG. 23E, after the first wire feeding unit 112 is moved from the first to the second position while the clamper 155 is open, the clamper 155 is closed and the end portion of the wire 4 at the side of the unit 112 is clamped between the upper roller 142 and the lower roller 156. The cutter 164 of the wire feeding unit 112 is then actuated to cut the wire 4. When the wire 4 is cut in this manner, as shown in FIG. 23F, the drive motor 95 is driven again to move the first wire feeding unit 112 to its front position. During this movement of the unit 112, the unit 125 is also pivoted counterclockwise as in FIG. 23E. Compressed air is blown from the nozzles 181 of the blow pipe 180, and any portion of the wire 4 which is loosely held between the head chip 3 and the unit 112 is horizontally blown. Therefore, even if the wire 4 is loosened upon movement of the first wire feeding unit 112 toward the holding means 11, the wire 4 may not be entangled or twisted.

Figure 23G:
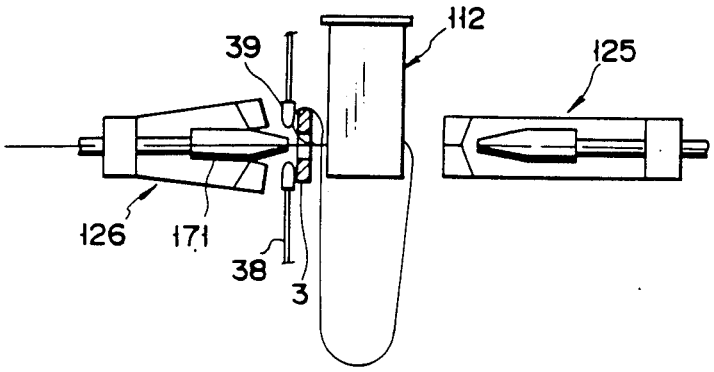

When the wire feeding unit 112 is moved in this manner, the front end of the wire 4 cut by the cutter 164 of the unit 112 is opposite to the square hole 5 of the head chip 3, as shown in FIG. 23G. As the wire feeding unit 112 is moved, the second table 92 is driven to move toward the holding means 11. At the same time, the second wire suction unit 126 is driven by the X-direction cylinder 128 and the distal end of the sleeve 171 is opposite the square hole 5 of the head chip 3. In this state, the upper roller 142 of the first wire feeding unit 112 is driven and the wire 4 is fed toward the head chip 3. At the same time, the vacuum pump 182 is actuated to apply a suction force on the sleeve 171 of the second wire suction unit 126. The wire 4 is thus drawn by suction to the second wire suction unit 126 from the first wire feeding unit 112 through the square hole 5 in the head chip 3. When the wire 3 is drawn to some extent, the lower roller 156 of the first wire feeding unit 112 is moved to be separated from the upper roller 142. Thereafter, the first wire feeding unit 112 is moved from the second position to the first position, and the wire 4 is removed from the rollers 142 and 156. Then, the portion of the wire 4 which is to the right of the head chip 3 is completely drawn by suction to the second wire suction unit 126. When the wire 4 is thus drawn by suction to the second wire suction unit 126, the sleeve 171 of the unit 126 is moved to the rear position and the wire 4 is clamped by the elastic members 174.

Figure 23H:
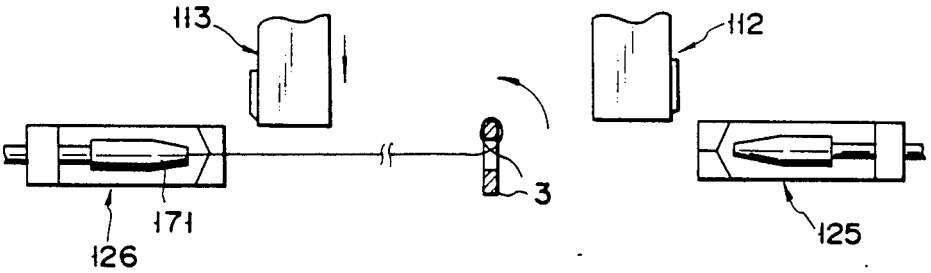
Figure 231:
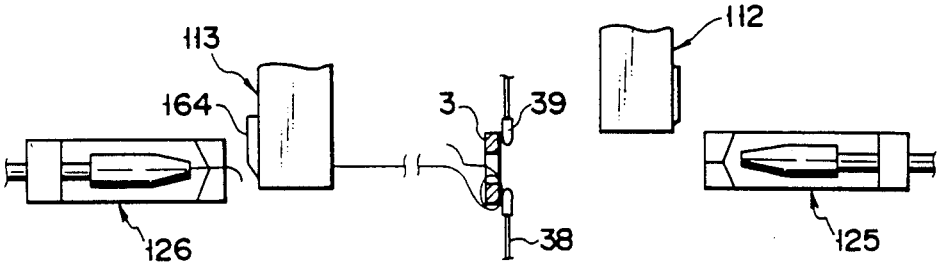

As shown in FIG. 23H, the second table 92 is moved away from the holding means 11. Thus, the second wire feeding unit 113 and the second wire suction unit 126 are moved to the rear position. The wire 4 is thus suspended between the head chip 3 and the second wire suction unit 126. At the same time, the first table 91 is moved away from the holding means 11, and the first wire feeding unit 112 and the first wire suction unit 125 are withdrawn to predetermined positions. During this movement, the first wire feeding unit 112 is pivoted by 180° in the direction opposite that described above to return to the original position. Subsequently, after the first press member 38 of the holding means 11 is pivoted to be moved away from the sides of the square hole 5 of the head chip 3, the holding means 11 is pivoted counterclockwise 180° from the second to the first position together with the head chip 3. Thereafter, the first press member 38 is actuated to urge the elastic members 49 toward the sides of the square hole 5 of the head chip 3 and to prevent any loosening of the wire 4.

As shown in FIG. 23I, the second wire feeding unit 113 is moved from its first to second position, and the leading end of the wire 4 is clamped between the upper and lower rollers 142 and 156. The cutter 164 of the second wire feeding unit 113 is actuated, and the wire 4 is cut between the unit 113 and the second wire suction unit 126.

Figure 23J:
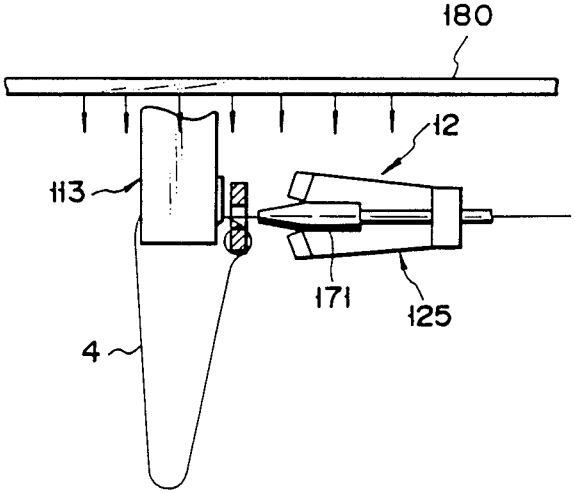

Then, the second wire suction unit 126 is moved to its front position and is pivoted by 180°. Then, as shown in FIG. 23J, the leading end of the cut wire 4 is opposite the square hole 5 of the head chip 3. The first wire feeding unit 112 and the first wire suction unit 125 are moved to the front positions, and the sleeve 171 is projected such that its distal end is opposite the square hole 5. The upper roller 142 of the second wire feeding unit 113 is driven in this state to feed the wire 4, and the wire is drawn by suction by the first wire suction unit 125 through the square hole 5 of the head chip 3. When the wire 4 is drawn to some extent, the lower roller 156 of the second wire feeding unit 113 is moved away from the upper roller 142, and thereafter the unit 113 is moved to the first position. Thus, the wire 4 is removed from the gap between the rollers 142 and 156 and is drawn by suction by the first wire suction unit 125. The wire 4 is thus wound two turns around one side of the square hole 5 of the head chip 3.

During the winding operation of the wire 4 decribed above, as shown in FIG. 23K, compressed air is blown from the nozzle 184 of the second blow pipe 183 against the wire 4 to be wound around the head chip 3. Therefore, the wire 4 wound around the head chip 3 will not extend above the head chip and will be wound at a predetermined position thereof. A crossing wire 187 to cross the square hole when the wire 4 is wound on a second side after it has been wound on another side of the square hole 5 is blown to a lower position of the square hole 5 by compressed air. Therefore, the winding operation of the wire 4 can not be prevented by the crossing wire 187.

When the wire 4 is wound one turn around the head chip 3 by the first and second wire feeding units 112 and 113, and the first and second wire suction units 125 and 126, one cycle of the winding operation is completed to achieve the state shown in FIG. 23J. The wire feeding units and the wire suction units repeat the above cycle to wind the wire 4 by a predetermined number of turns around the head chip 3.

The winding apparatus 6 as described above can automatically wind the wire 4 around the head chip 3. Therefore, winding efficiency and yield can be significantly improved, and the workload on the worker can be greatly reduced.

In the embodiment described above, the holding means 11 is in a position such that the rotating axis of the video head 1 is perpendicular to the surface of the base 10. However, the holding means 11 can be located such that the rotating axis of the head 1 is parallel to the surface of the base 10. In this case, the direction of blowing the loosened wire 4 upon movement of the wire feeding units 112 and 113 is not horizontal but vertical. Therefore, blow pipe 180 can be arranged above and below the wire 4 so as to blow air toward the wire 4, thereby preventing entanglement or twisting of the wire 4.

It is to be understood that the object on which a wire is to be wound is not limited to the head chip 3 of the video head 1.

The second embodiment of the present invention will now be described with reference to FIGS. 24 to 30. The same reference numerals as those in the first embodiment denote the same parts in this embodiment, and only those parts which are different from those of the first embodiment will be described below.

Figure 24:
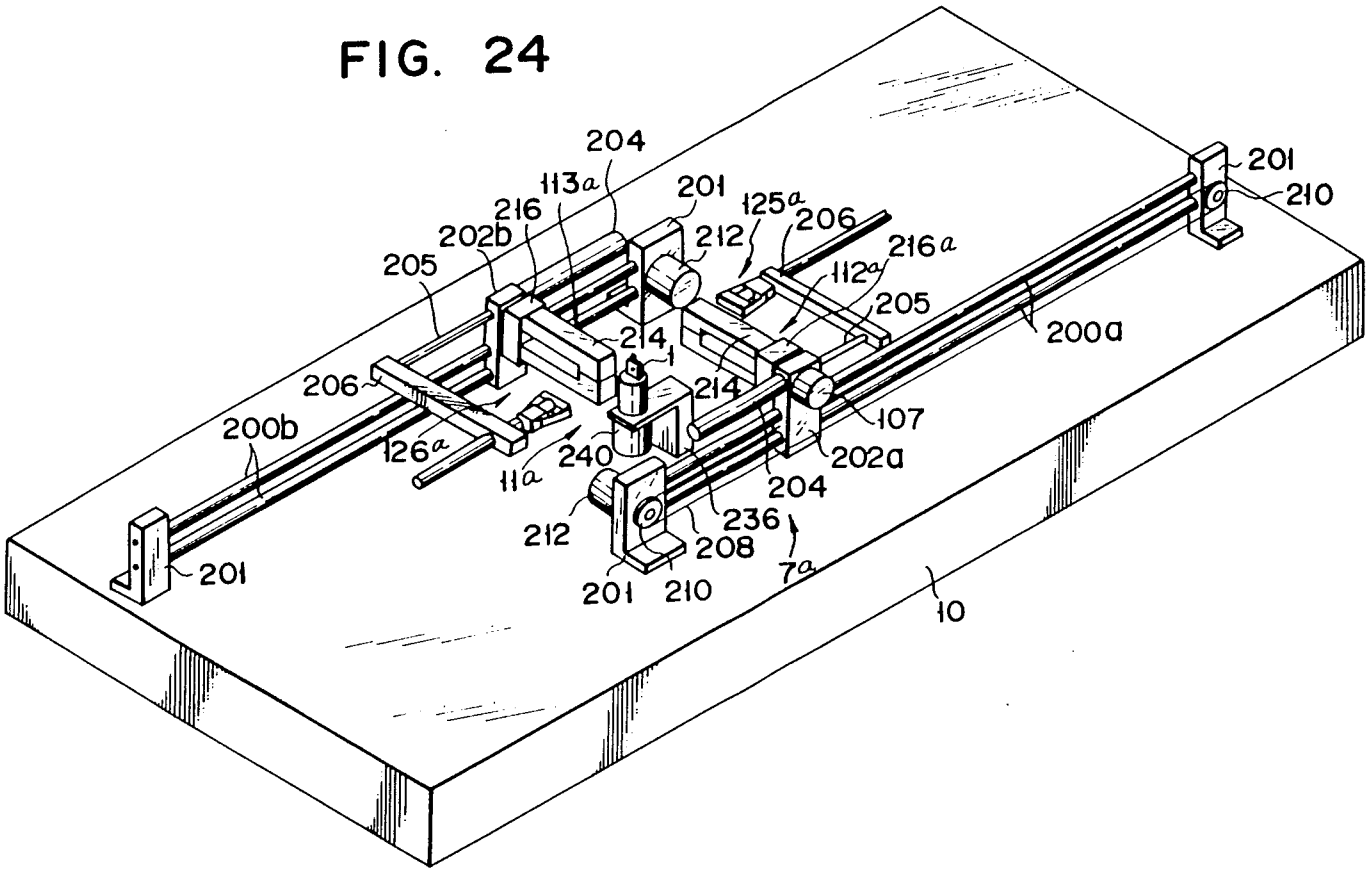

As shown in FIG. 24, a holding means **11*a* is arranged at the central portion of the upper surface of a base 10. A guide mechanism 7*a* has a pair of first guide rods 200*a* and a pair of second guide rods 200*b* at the two sides of the holding means 11*a*. The pairs of guide rods 200*a* and 200*b* extend parallel to each other along the length of the base 10, and are spaced apart from each other along the width of the base 10. The pairs of guide rods 200*a* and 200*b* are shifted from each other on the base 10 along its length. The ends of the guide rods 200*a* and 200*b* are supported by mounts 201 extending upright on the base 10. Sliders 202*a* and 202*b* are slidably mounted on the two sets of guide rods 200*a* and 200*b*, respectively. A first wire feeding unit 112*a* and a first wire suction unit 125*a* are mounted on the slider 202*a*, while a second wire feeding unit 113*a* and a second wire suction unit 126*a* are mounted on the slider 202*b*. The first and second wire feeding units 112*a* and 113*a* extend perpendicular to the moving direction of the sliders 202*a* and 202*b*, and are opposite to each other with the holding means 11*a* interposed therebetween. The first and second wire feeding units 112*a* and 113*a* are driven to rotate by pulse motors 107*a* mounted on the sliders 202*a* and 202*b*. The first and second wire suction units 125*a* and 126*a* are respectively mounted on one end of each of mounting rods 206 each of which is coupled at the other end to a rod 205 of a corresponding cylinder 204. The cylinders 204 are mounted on the sliders 202*a* and 202*b*. The first and second wire suction units 125*a* and 126*a* are opposite the first and second wire feeding units 112*a* and 113*a***, respectively.

A drive belt 208 is coupled to each slider **202*a* or 202*b*. Each belt 208 is looped around pulleys 210 mounted on the mounts 201 of the corresponding guide rods 200*a* or 200*b*. Of the two pulleys for each drive belt 208, one pulley 210 is driven by a pulse motor 212. When the drive belt 208 is driven, the corresponding slider 202*a* or 202*b* is driven, and the units 112*a* and 125*a* or the units 113*a* and 126*a* are driven to be moved toward or away from the holding means 11*a*. The wire suction units 125***a* and 126*a* can also be independently driven by the cylinders 204.

Figure 25:
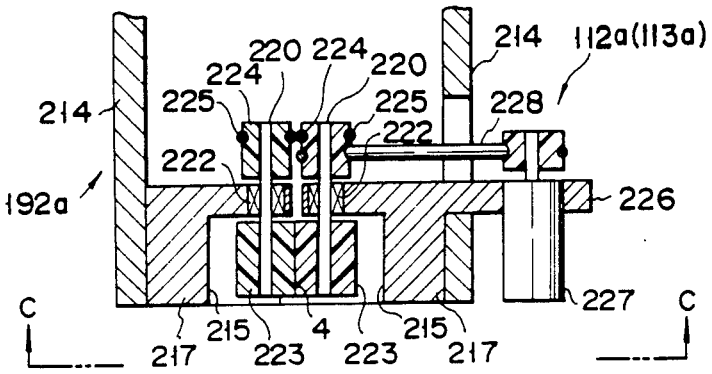
Figure 26:
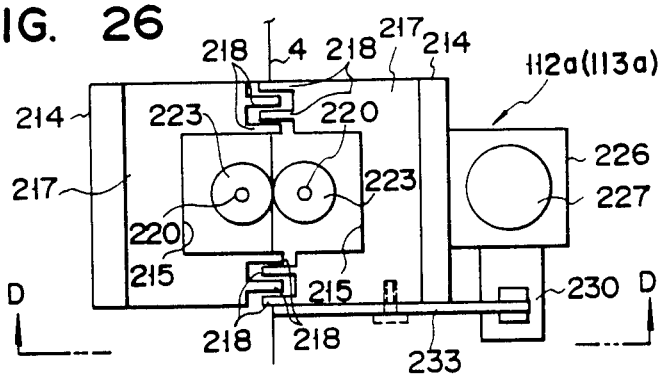
Figure 27:
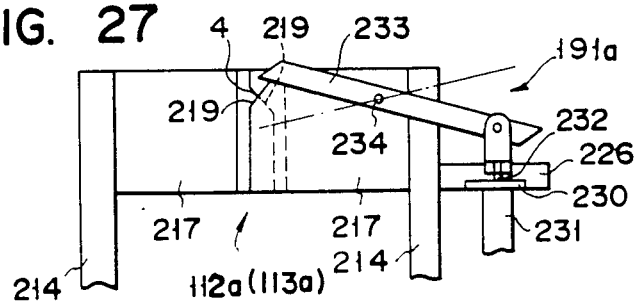

The first and second wire feeding units 112*a* and 113*a* have the construction as shown in FIGS. 25 to 27. Each wire feeding unit 112*a* or 113*a* has a pair of arms 214 which extends parallel to each other along the width direction of the base 10. One end of each arm 214 is coupled to an open/close mechanism 216 on the corresponding slider 202*a* or 202*b* so as to be vertically opened or closed with respect to the upper surface of the base 10. Blocks 217 are fixed on the opposite surfaces at the other end of each of the arms 214. The blocks 217 have recesses 215 and teeth 218 which mesh with each other when the blocks 217 are closed. V-shaped notches 219 are formed in the teeth 218. The wire 4 to be wound around the head chip 3 is passed between the pair of blocks 217. When the blocks 217 are closed, the wire 4 is positioned by the notches 219 and is held slidable. A pivot shaft 220 having one end portion extending in the corresponding recess 215 is rotatably supported on each block 217 through a bearing 222 and extends parallel to the arms 214. A feed roller 223 for feeding the wire 4 is fitted to one end of the corresponding pivot shaft 220, and a drive roller 224 is mounted on its other end. O-rings 225 are mounted on the outer surfaces of the drive rollers 224 and are urged against each other when the blocks 217 are closed. A first support piece 226 is mounted on one block 217, and a pulse motor 227 is mounted on the first support piece 226. A drive belt 228 is looped around the pulse motor 227 and the one driver roller 224. When the pulse motor 227 is driven in a state that the blocks 217 are closed, the pair of feed rollers 223 are driven to feed the wire 4 clamped therebetween. A second support piece 230 extends from the first support piece 226. A cylinder 231 is mounted on the second support piece 230 to extend parallel to the arms 214. One end of a cutter 233 as a cutting mechanism 191*a* is pivotally mounted on a rod 232 of the cylinder 231. An intermediate portion of the cutter 233 is pivotally supported on the outer surface of one of the blocks 217 by a pivot shaft 234. The other end of the cutter 233 is opposite the notches 219 of the teeth 218 of each block 217. Therefore, when the cylinder 231 is operated to pivot the cutter 233, the wire 4 fed from the notches 219 is cut.

Figure 28:
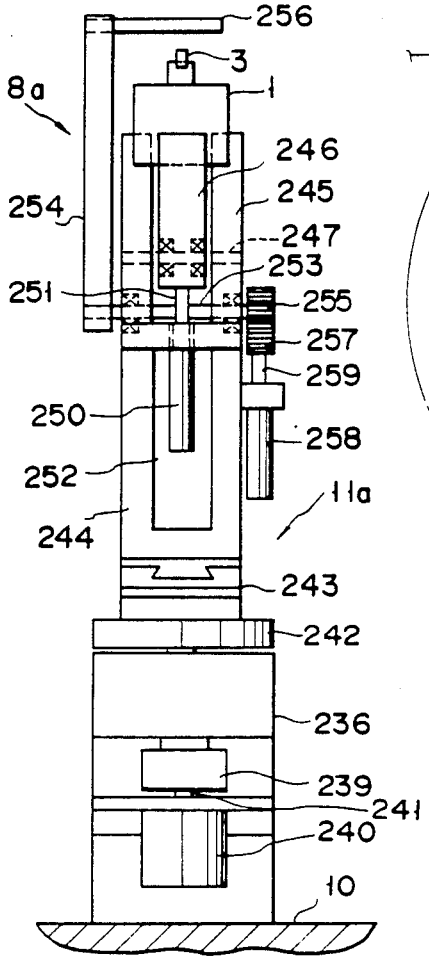
Figure 29:
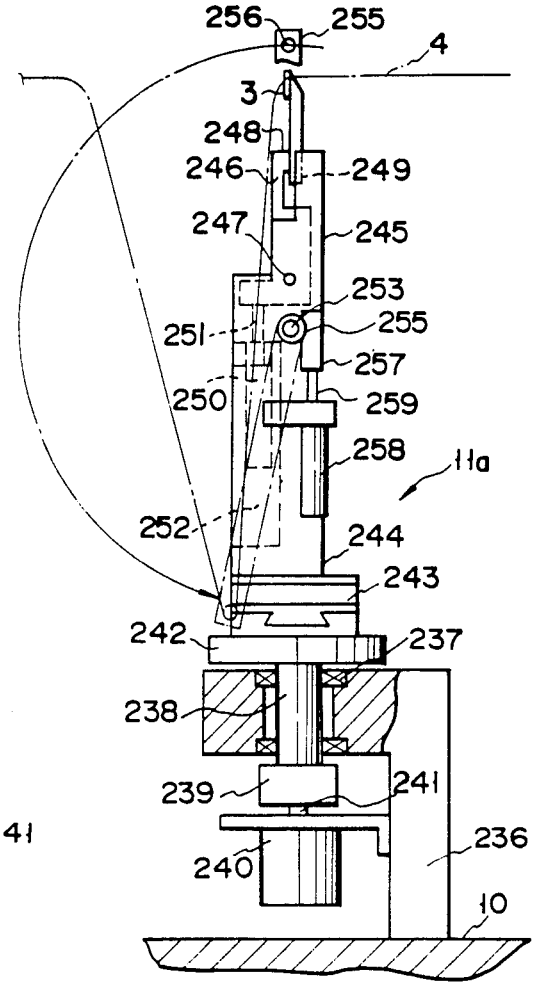

The holding means 11*a* has the construction shown in FIGS. 28 and 29. An L-shaped support 236 stands upright from the central portion of the upper surface of the base 10. A pivot shaft 238 is pivotally supported by a bearing 237 on one horizontal side of the support 236. A rotating shaft 241 of a pulse motor 240 mounted on the support 236 is coupled to the lower end of the pivot shaft 238 through a universal joint 239. A disc 242 is coaxially mounted at the upper end of the pivot shaft 238, and an X-Y table 243 driven in both the X- and Y-directions by a drive source (not shown) is mounted on the disc 242. A columnar member 244 is mounted on the X-Y table 243 to extend perpendicular to the base 10. The member 244 is rotated by the pulse motor 240 between first and second positions which are separated by 180°. A U-shaped support portion 245 is formed at the upper portion of the member 244. An L-shaped clamp member 246 is pivotally mounted by a pivot shaft 247 at an intermediate portion of the support portion 245. The video head 1 is clamped between a projection 248 formed at upper end of the clamp member 246 and a recess 249 formed at the upper end of the support portion 245. The distal end of a rod 251 of a clamp cylinder 250 is opposite the lower end at the other end of the clamp member 246. The clamp cylinder 250 is received in a recess 252 formed at one side of the member 246. When the rod 251 of the cylinder 250 is biased to project therefrom, the rod 251 presses the other end of the clamp member 246. Therefore, the projection 248 of the clamp member 246 is received in the recess 249 of the support portion 245. In this manner, the support portion 245, the clamp member 246, and the clamp cylinder 250 together constitute a holding mechanism for holding the video head 1.

A mounting shaft 253 is rotatably supported on the lower end of the support portion 245 such that is extends horizontally and has its two ends extending outward from the sides of the support portion 245. One end of an arm 254 is coupled to one end of the mount shaft 253, and a pinion 255 is mounted on the other end of the mount shaft. A press shaft 256 is horizontally coupled to the other end of the arm 254. When the arm 254 is substantially vertical, the press shaft 256 is located above the video head 1 clamped by the support portion 245 and the clamp member 246. When the press shaft 256 is pivoted downward, it is brought into contact with a side surface of the X-Y table 243. At this time, since the press shaft 256 is pivoted with engaging with one end of the wire 4 inserted through the square hole 5 of the head chip 3, one end of the wire 4 is clamped securely by the press shaft 256 and the abutting side surface of the X-Y table 243. Therefore, the wire 4 will not slide. A rack 257 meshes with the pinion 255. The rack 257 is coupled to a rod 259 of a drive cylinder 258 mounted at a side surface of the columnar member 244. When the rack 257 is driven by the drive cylinder 258, the pinion 255 is rotated. The mounting shaft 253 and the arm 254 are also rotated. In this manner, the arm 254, the press shaft 256 and the drive cylinder 258 together constitute a fixing mechanism 8 for fixing one end of the wire 4 inserted in the square hole 5 of the head chip 3.

Figure 30:
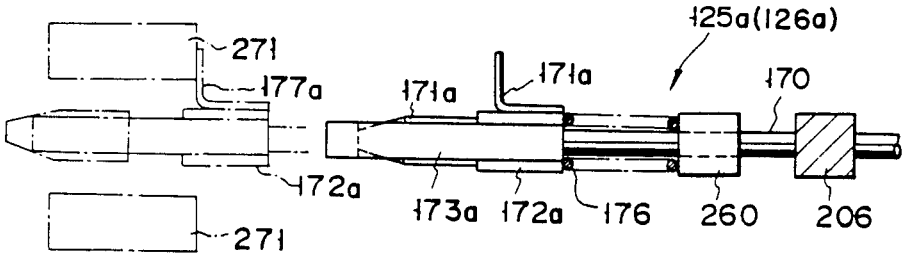
Figure 31:
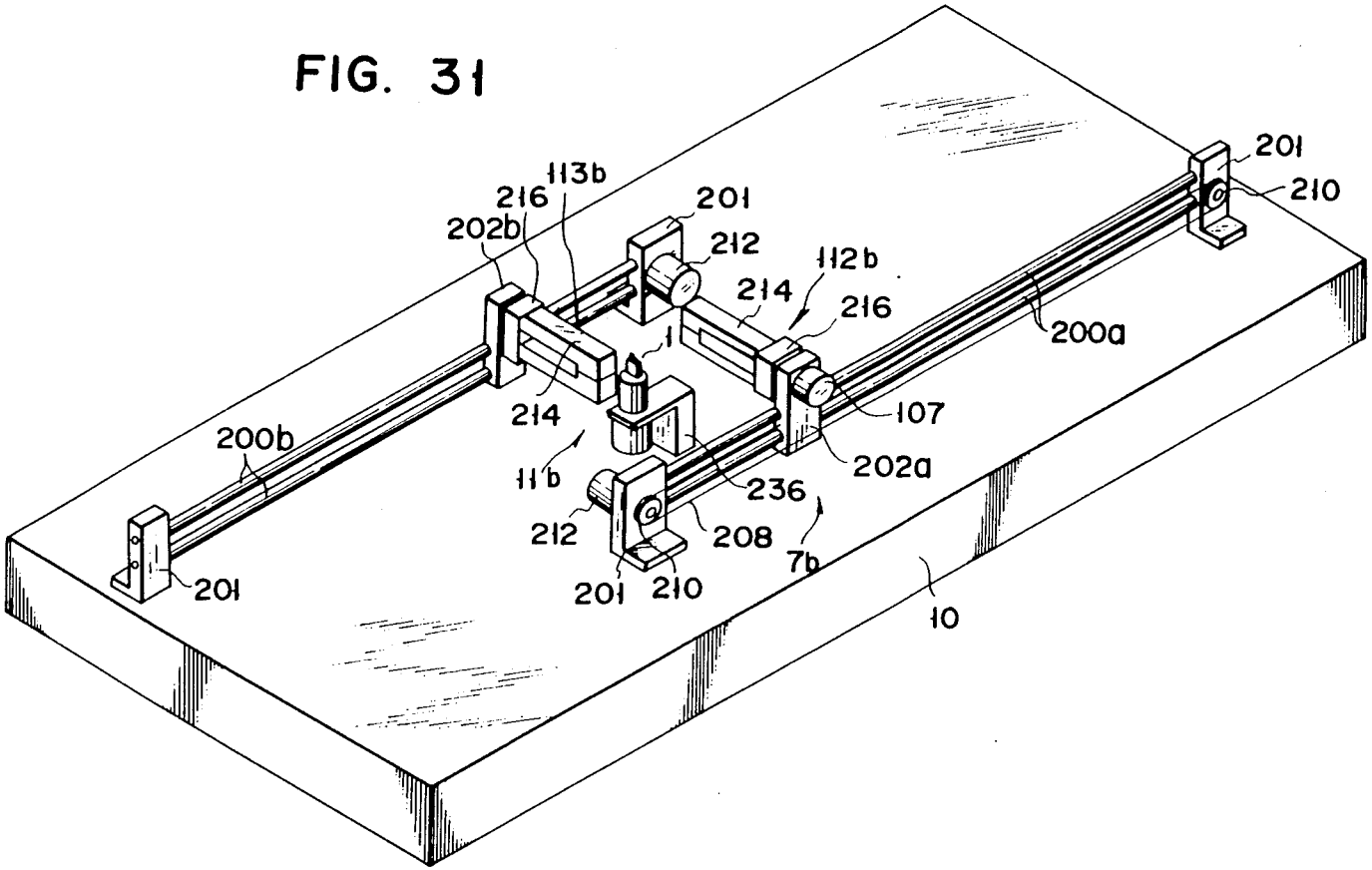

In this embodiment, locking pieces 177*a* of the wire suction units 125*a* and 126*a* are mounted such that they are abutted against the blocks 217 of the wire feeding units 112*a*, 113*a* when a pipe 170 is driven, as shown in FIG. 30. Reference numeral 260 denotes a stopper fixed to the pipe 170.

The center of the square hole 5 of the head chip 3, the center of the wire 4 clamped by the first and second wire feeding units 112*a* and 113*a*, and the center of the pipe of the first and second wire suction units 125*a* and 126*a* are aligned.

A wire supply unit 12*a* similar to that of the first embodiment is arranged on the base 10 and extends to a position near the holding means 11*a*.

In the winding apparatus having the above construction, an operation similar to that of the first embodiment is performed to allow automatic winding of the wire 4 on the head chip 3.

In the fixing mechanism 8 of the wire 4, the press shaft 256 may be directly driven in the vertical direction by the drive cylinder 258 without using the arm 254, but may be abutted against the holding means 11*a* when it is moved downward. The same wire feeding units as those used in the first embodiment can be used in the second embodiment.

FIGS. 31 to 34 show a third embodiment of the present invention. This embodiment is different from the second embodiment in that the wire suction units are omitted, and that the wire feeding units 112*b* and 113*b* have a different structure from that in the second embodiment. Since the remaining features are the same as those of the second embodiment, such features will not be described.

Figure 32:
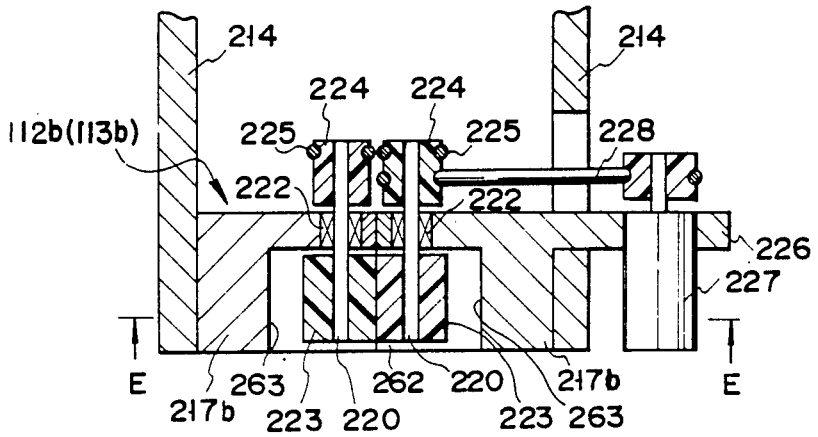
Figure 33:
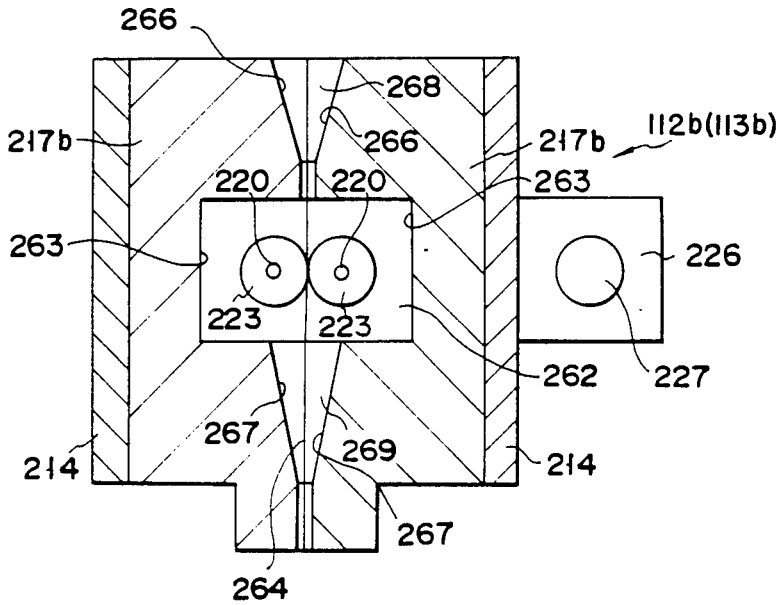

As shown in FIGS. 32 and 33, each wire feeding unit 112*b* or 113*b* has blocks 217*b* with a different structure from that of the second embodiment. Recesses 263 are formed in the opposite inner surfaces of the blocks 217*b* so s to define a hole 262 with a bottom at the center when the blocks 217*b* are closed. Pairs of guide grooves 266 and 267 are formed on the closing surfaces 264 at the sides of the recesses 263 of the blocks 217*b* such that the guide grooves 266 and 267 are symmetrical with respect to the closing surfaces 264, and form first and second guide holes 268 and 269 of a conical shape to be coaxial with each other at the sides of the hole 262. The holes 268 and 269 have a larger diameter toward the upper ends and communicate with the hole 262. The guide holes 268 and 269 are formed to be coaxial with the square hole 5 of the head chip 3 of the video head 1 held by the holding means 11*b*. The outer diameter of feed rollers 233 in the recesses 253 is such that the contact point between the rollers 223 is on the closing surfaces 254 of the blocks 217*b* when the blocks are closed.

The operation of the winding apparatus according to the third embodiment of the present invention will be described below.

Figure 34A:
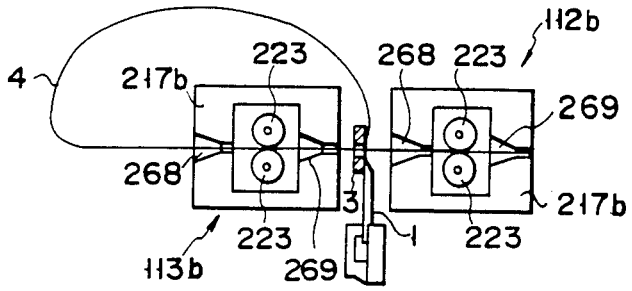
Figure 34B:
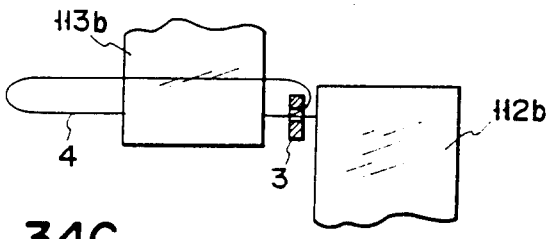
Figure 34C:
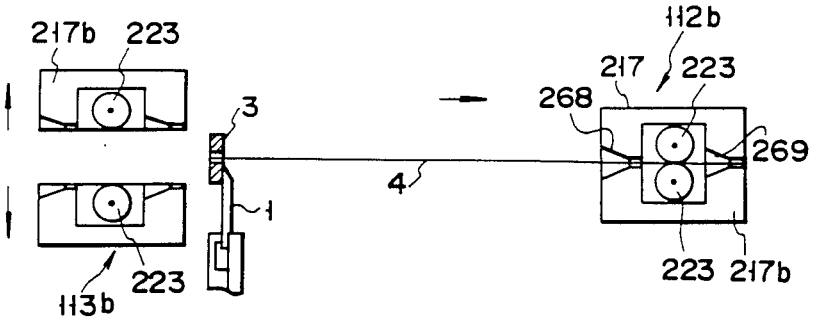
Figure 34D:
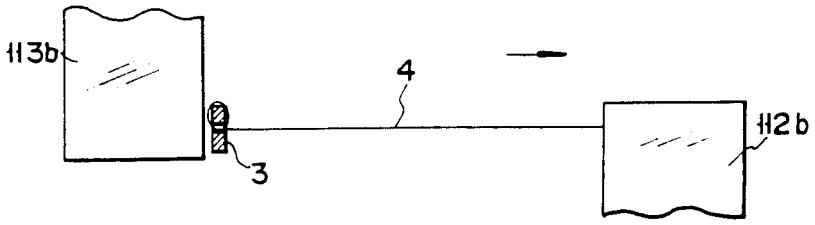

FIGS. 34A and 34B show a state wherein the wire 4 is looped around the video head 1. In this state, the blocks 217*b* of the wire feeding units 112*b* and 113*b* are closed, and the feed rollers 223 are stopped. The leading end of the wire 4 is clamped by the feed rollers 233 of the first wire feeding unit 112*b*. The units 112*b* and 113*b* are set such that the larger diameter portions of the guide holes 268 and 269 are at the left side in FIG. 34A. In order to continue the winding operation from this point, the blocks 217*b* of the second wire feeding unit 113*b* are opened by the open/close mechanism 216 in the direction indicated by the arrows in FIG. 34C. Thereafter, the first wire feeding unit 112*b* is withdrawn by the guide mechanism 7 in the direction indicated by the arrow. Then, the wire 4 inserted in the square hole 5 is pulled in the direction indicated by the arrow in FIG. 34D, and the loop is contracted, thereby being wound around the head chip 3.

Figure 34E:
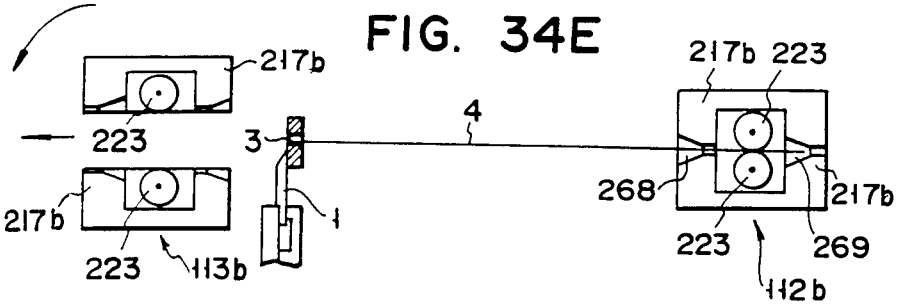
Figure 34F:
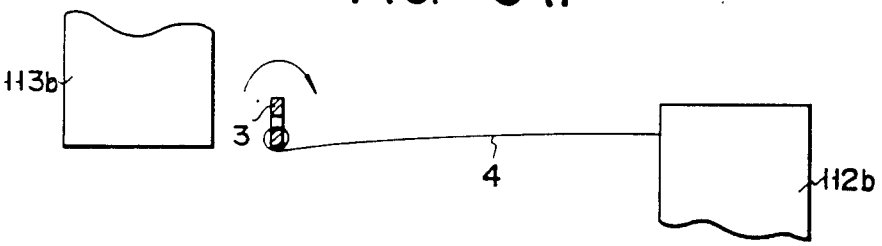
Figure 34G:
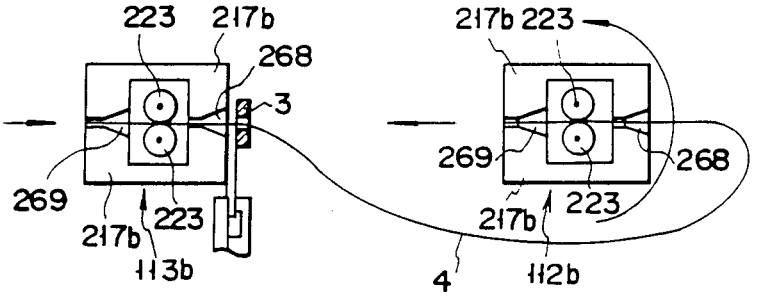
Figure 34H:
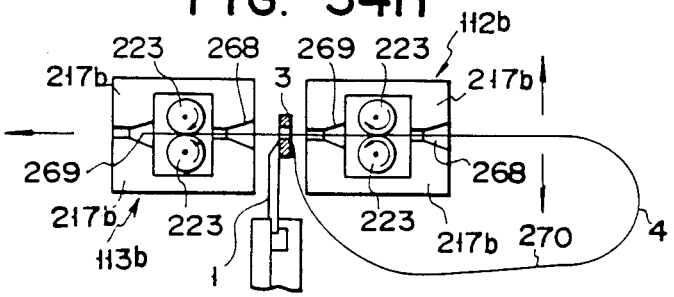

As shown in FIGS. 34E and 34F, the second wire feeding unit 113*b* is slightly withdrawn by the guide mechanism 7*b* in the direction indicated by the arrow. At the same time, as the blocks 217*b* are spaced apart from each other, the wire feeding unit 113*b* is rotated by 180° in the direction of the arrow. The video head 1 is rotated clockwise by the holding means 11*b*, and the wire 4 is thus wound around the head chip 3 by a length corresponding to the amount of rotation of the video head 1. Subsequently, as shown in FIG. 34G, while the leading end of the wire 4 is clamped by the rollers 223 of the first wire feeding unit 112*b*, the unit 112*b* is moved forward in the direction of the arrow and toward the video head 1 by the guide mechamism 7*b*. During this movement, the unit 112*b* is rotated by 180° in the direction of the arrow. Thus the larger-diameter sides of the guide holes 268 and 269 of the units 112*b* and 113*b* are located at the right portion, as shown in FIG. 34G. At the same time, the second wire feeding unit 113*b* is also moved toward the video head 1. The feed rollers 223 of the first and second wire feeding units 112*b* and 113*b* are rotated in the direction indicated by the arrow shown in FIG. 34H, and the wire 4 is fed in the direction indicated by the arrow. Then, the leading end of the wire 4 is inserted through the square hole 5 of the head chip 3 and reaches the second wire feeding unit 113*b* to form a loop 270. When the leading end of the wire 4 is clamped by the feed rollers 223 of the second wire feeding unit 113*b*, the rotation of the feed rollers 223 of the units 112*b* and 113*b* is stopped. Then, the blocks 217*b* of the first wire feeding unit 112*b* are opened in the direction indicated by the arrows by the open/close mechanism 216. The second wire feeding unit 113*b* is thereafter withdrawn by the guide mechanism 7*b*. Then, the wire 4 which has been passed through the square hole 5 is pulled in the direction indicated by the arrow, the loop 270 is contracted, and the wire 4 is wound around the head chip 3. The above cycle is repeated to wind a predetermined amount of wire 4 around the head chip 4.

In this manner, in the third embodiment, the wire 4 can be automatically wound around the head chip 3 as in the first and second embodiments.

Figure 35:
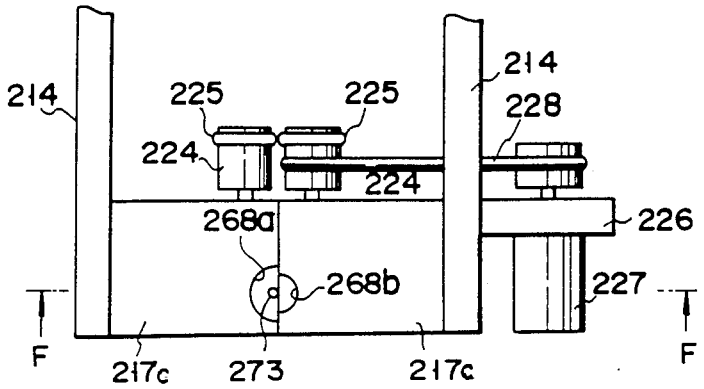
Figure 36:
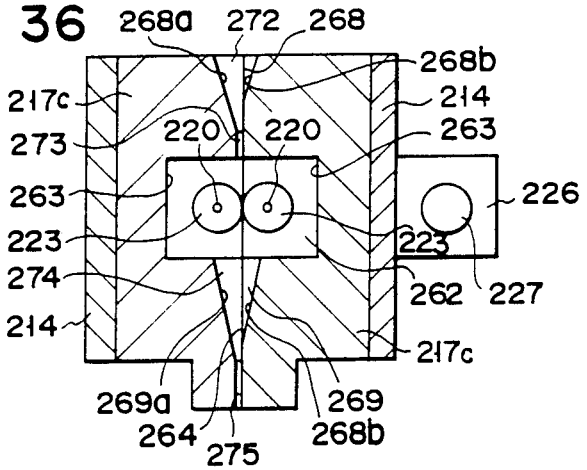
Figure 37:
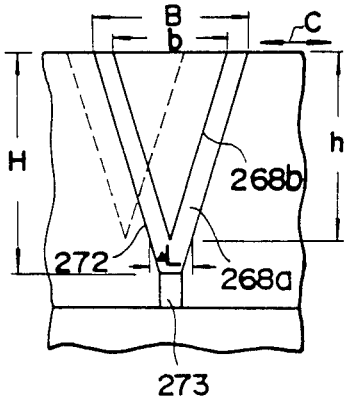

In the third embodiment, the first and second guide holes 268 and 269 can be formed as shown in FIGS. 35 to 37. On the closing surface of the block 217*c* located left side in FIG. 36, grooves 268*a* and 269*a* are formed above and below the hole 262. The grooves 268*a* and 269*a* have a shape obtained by dividing a cone into half along a plane including an axis thereof. The groove 268*a* has a tapered groove section 272 which has a larger-diameter portion at the upper end and which opens to the side surface of the block 217*c*. It also has a narrow groove section 273 for positioning the wire 4, which has one end communicating with the smaller-diameter portion of the tapered groove section 272 and the other end open to the hole 262. Similarly, the groove 269*a* has a tapered groove section 274 which has a larger-diameter portion at the upper end and opens to the hole 262, and a narrow groove section 275 for positioning the wire 4, which has one end communicating with the smaller-diameter portion of the tapered groove section 274 and the other end opening to the side surface of the block 217*c*. These narrow groove sections 273 and 275 have a size to allow insertion of the wire 4 therethrough. Grooves 268*b* and 269*b* are formed above and below the hole 262 and on the closing surface 264 of the other block 217*c*. The grooves 268*b* and 269*b* have the shape obtained by dividing a cone into half along a plane including an axis thereof, as in the grooves 268*a* and 269*a*. These grooves 268*b* and 269*b*, however, do not have the narrow sections as the grooves 268*a* and 269*a*, but they are tapered by the same angle as that of the tapered groove sections 272 and 274. The upper ends of the grooves 268*b* and 269*b* open to the side surfaces of the blocks 217*c* and to the hole 262. The grooves 268*b* and 269*b* are formed such that the vertices thereof are located within the open regions of the tapered groove sections 272 and 274 on the closing surfaces 264 when the blocks 217 are closed. The grooves 268*b* and 269*b* are thus formed to be similarly smaller than the tapered groove sections 272 and 274. As shown in FIG. 37, a length B of a bottom line and a height H of the tapered groove section 272 or 274 of another isosceles triangle at the closing surface 264 of the block 217*c* are set to be larger thn a length b of a bottom line and a height h of the groove 268*b* or 269*b* of an isosceles triangle. The upper opening of the tapered groove section 272 or 274 is level with that of the groove 268*b* or 269*b*.

When the guide holes 268 and 269 are formed as described above, even if the blocks 217*c* are shifted from each other in directions (directions of arrows C in FIG. 37) perpendicular to the insertion direction of the wire 4 in a state that the blocks are closed, the wire 4 can be securely positioned and guided by the guide holes. In other words, even if the blocks 217*c* are shifted from each other in the directions of the arrows C within a range of a distance ΔL, the vertices of the grooves 268*b* and 269*b* are located within the tapered groove sections 272 and 274, respectively. Therefore, as long as the vertices of the grooves 268*b* and 269*b* are located within the sections 272 and 274, the wire 4 can be reliably guided by the narrow groove sections 273 and 275. However, if the vertices of the guide grooves 268*b* and 269*b* fall outside the tapered groove sections 272 an 274, as indicated by the broken line in FIG. 37, blind hole portions are formed respectively in the guide holes 268 and 269 which prevent insertion of the wire 4. For this reason, the shift amount or distance of the blocks 217*c* must fall within the range of distance ΔL. However, if grooves of the same shape as that of the groove 268*a* are symmetrically formed in both blocks 217*c*, that is, if the wire can be inserted only if the pair of narrow groove sections 273 and 275 are aligned with each other, the slightest shift between the blocks 217*c* may prevent insertion of the wire 4. As compared to this, in accordance with this modification, insertion and positioning of the wire 4 can be smoothly and reliably performed.

Figure 38:
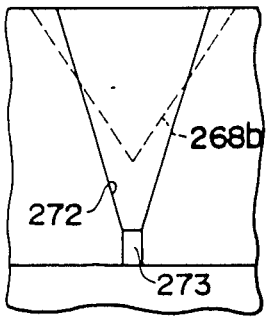

In the third embodiment and modification thereto described above, the number of guide holes can be arbitrarily set. The pivot shafts 220 are driven such that one pivot shaft 220 serves as a drive shaft while the other pivot shaft 220 serves as a driven shaft. However, the two pivot shafts 220 may be driven independently of each other while being synchronized in rotation. Power transmission to the drive rollers 224 need not be performed through the O-rings 225 but through gear mechanisms. The number of feed rollers is not limited to two; a number of gears can be arranged in tandem with each other as needed. Of the pair of feed rollers 223, one can be made of a flat plate. The groove shape is not limited to a conical shape but may be another cone shape. In the modification described above, the shape of each guide groove formed in the blocks 217*b* at the closing surfaces 264 therebetween is an isosceles triangle. However, as long as the vertices of the grooves 268*b* and 269*b* fall within the range of the tapered grooves 272 and 274, the grooves may be of any other triangular shape such as a regular triangle. Furthermore as shown in FIG. 38, the tapered groove sections 272 and 274, and the grooves 268*b* and 269*b* need not be tapered at the same angle.

The fourth embodiment of the present invention will now be described with reference to FIGS. 39 to 54F.

Figure 39:
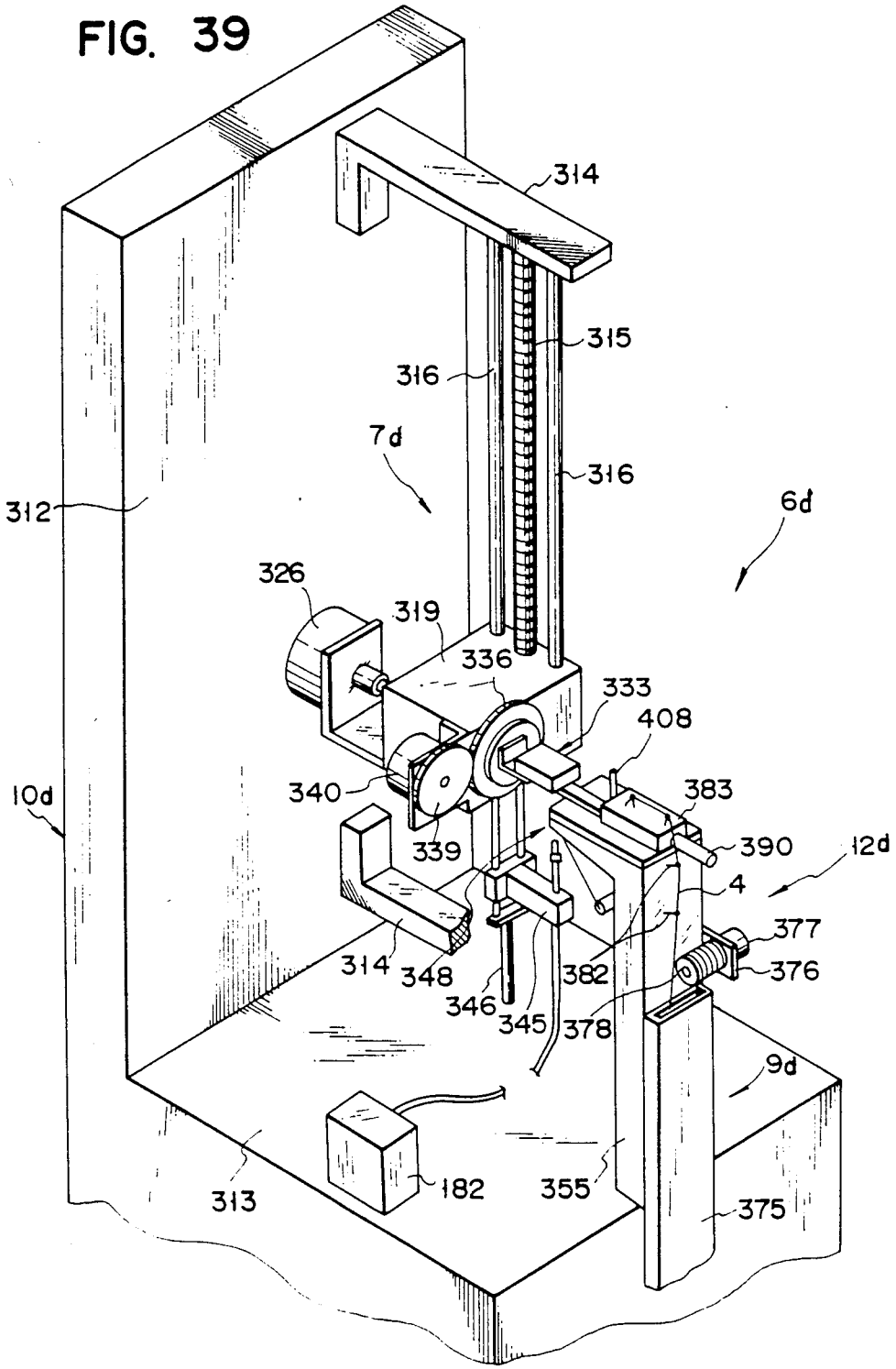
Figure 40:
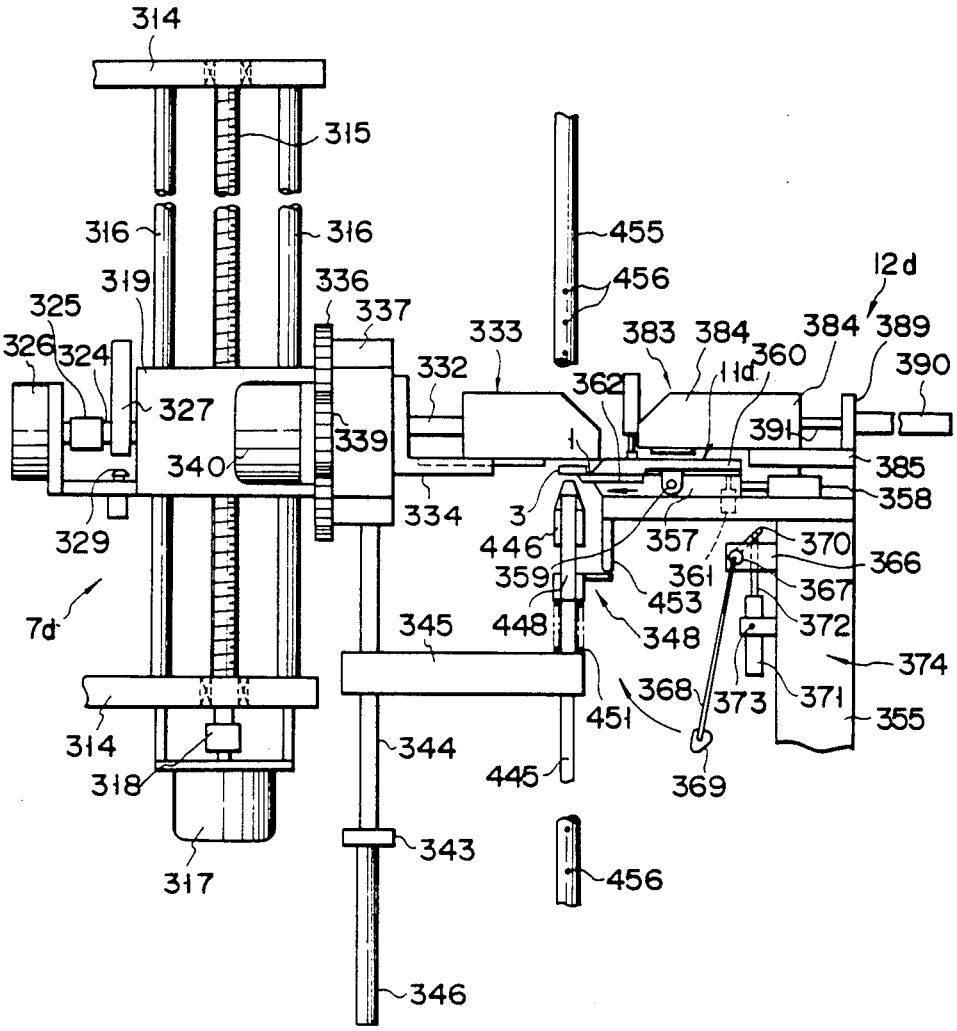
Figure 42:
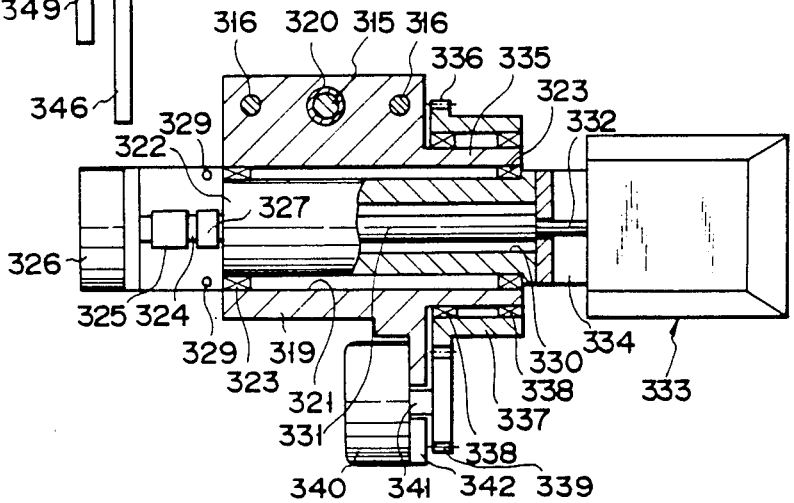

As shown in FIGS. 39 and 40, the winding apparatus 6*d* has a base 10*d* which, in turn, has a vertical surface 312 and a horizontal surface 313 which cross at right angles. One end of each of a pair of support members 314 which partially constitute a guide mechanism 7*d*, is fixed to the upper or lower end of the vertical surface 312 of the base 10*d*. The support members 314 extend horizontally and parallel to each other. A rotatable screw shaft 315 and a pair of guide rods 316 are mounted between the support members 314. The screw shaft 315 and guide rods 316 extend parallel to one another and to the vertical surface 312. A first motor 317 for driving the screw shaft 315 is mounted on the lower support member 314 and coupled to the lower end of the shaft through a coupling 318. A substantially box-like movable body 319 is slidably mounted on the guide rods 316. As shown in FIG. 42, a screw hole 320 is formed in the movable body 319 and mesh with the screw shaft 315. Therefore, when the screw shaft 315 is driven, the movable body 319 is vertically moved along the guide rods 316. A mounting hole 321 is formed in the movable body 319 so as to have its axis aligned with a direction perpendicular to the moving direction of the movable body 319. A cylindrical body 322 is coaxially and rotatably received in the mounting hole 321 through a bearing 323. That end of the body 322 which is located at the side of the vertical surface 312 is formed into a smaller-diameter portion 324. The smaller-diameter portion 324 is coupled through a coupling 325 to a second motor 326 mouted on the movable body 319. A stopper 327 is mounted on the smaller-diameter portion 324. The stopper 327 rotates together with the smaller-diameter portion 324 and abuts against dampers 329 arranged on the movable body 319, thereby regulating the rotation of the cylindrical body 322. The body 322 has a rotational angle of precisely 180°. As shown in FIG. 42, a recess 330 is formed in the body 322 to extend from the other end thereof along its axial direction. A first drive cylindrical 331 is housed in the recess 330. An actuating rod 332 of the first drive cylinder 331 is coupled to a wire feeding unit 333 to be described later. The wire feeding unit 333 is slidably mounted on one side of an L-shaped receptacle 334 having the other side fixed to the other end face of the cylindrical body 322.

The portion of the movable body 319 which supports the other end side of the cylindrical body 322 is formed into an annular mounting portion 335 coaxial with the body 322. A cylinder 337 having a first gear 336 formed around its outer surface at one end thereof is rotatably fitted around the mounting portion 335 through a bearing 338. A second gear 339 meshes with the first gear 336. The second gear 339 is fixed to a rotating shaft 341 of a third motor 340 which is mounted on a mounting piece 342 extending from the movable body 319. Therefore, the cylinder 337 is rotated by the third motor 340, and its rotational angle is controlled to be 180{ as in the case of the wire feeding unit 333.

Figure 41:
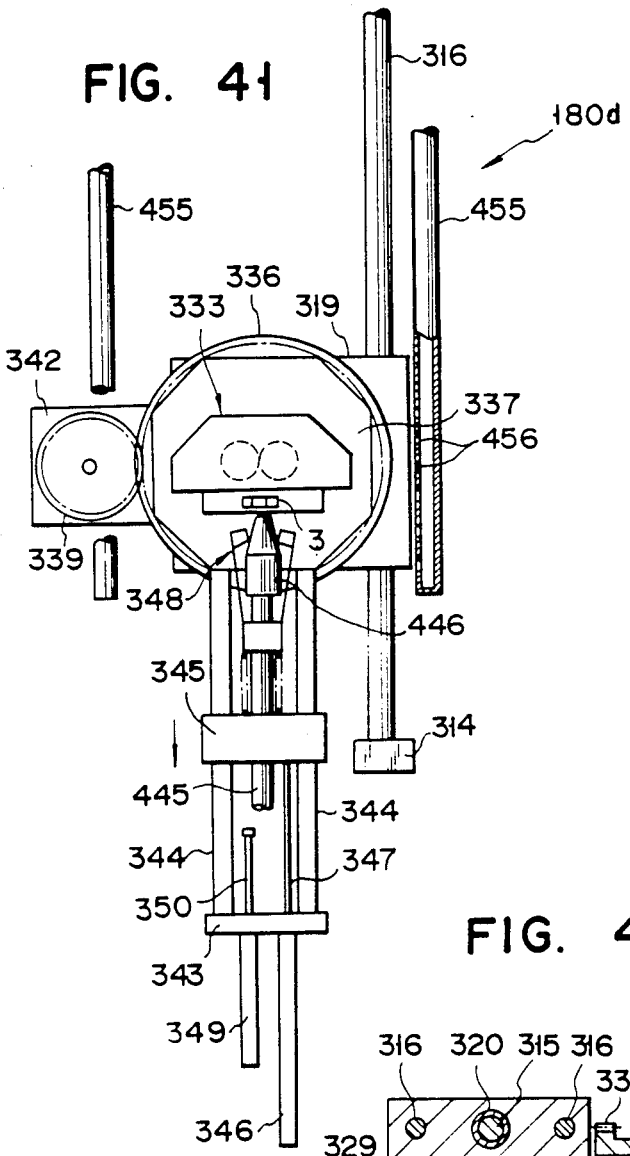

The outer circumferential surface of the cylinder 337 excluding a portion on which the first gear 336 is formed is formed into an octagonal shape, as shown in FIG. 41. To one side of the octagon is fixed one end of each of a pair of parallel guide rods 344 having the other end coupled through a connecting plate 343. A horizontal mounting arm 345 is slidably mounted on the guide rods 344. An actuating rod 347 of a second drive cylinder 346 held onto the connecting plate 343 is coupled to the mounting arm 345. When the second drive cylinder 346 is actuated, the mounting arm 345 slides along the guide rods 344. A wire suction unit 348 to be described later is mounted on the mounting arm 345. A positioning cylinder 349 is mounted on the coupling plate 343. An actuating rod 350 of the positioning cylinder 349 extends parallel to the guide rods 344. When the mounting arm 345 is moved in the direction indicated by the arrow in FIG. 41, the actuating rod 350 of the positioning cylinder 349 abuts against the mounting arm 345. Therefore, if the actuating rod 350 of the positioning cylinder 349 is projected, the mounting arm 345 and hence the wire suction unit 348 can be stopped at a position which is intermediate within the stroke of the second drive cylinder 346.

An inverted L-shaped pole 355 extends upright on the horizontal surface 313 of the base 10*d*. A holding means 11*d* is arranged on the upper surface at one side of the pole 355, as shown in FIG. 40. The holding means 11*d* has a slide member 357 which is arranged on the upper surface of the pole 355 to be slidable along the direction of the arrow, a third drive cylinder 358 for sliding the slide member 357, a gripper 360 having an intermediate portion pivotally mounted on the slide member 357 through a pivot shaft 359, and a fourth drive cylinder 361 for pivoting the gripper 360. A recess 362 is formed at the distal end portion of the slide member 357. The video head 1 shown in FIG. 1 on which a wire 4 is to be wound is mounted in this recess 362 and is gripped by the gripper 360. A wire supply unit 12*d* to be described later is arranged to extend on one vertical side surface of the pole 355 and above the holding means 11*d*. A predetermined length of the wire 4 to be wound around the head chip 3 is supplied from the wire supply unit 12*d*. A U-shaped bracket 366 is fixed on the vertical inner side surface of the pole 355. A mounting shaft 367 is rotatably supported on the bracket 366. One end of each of a pair of L-shaped press members 368 is fixed to each end of the mounting shaft 367. An elastic member 369 is mounted on the other end of each press member 368. A lever 370 extendes from an intermediate portion of the mounting shaft 367. An actuating rod 372 of a fifth drive cylinder 371 is coupled to the lever 370. The drive cylinder 371 is pivotally supported by a support member 373 on the vertical inner surface of the pole 355. Therefore, when the fifth drive cylinder 371 is actuated to withdraw the actuating rod 372, the press members 368 are pivoted in the direction indicated by the arrow, and the elastic members 369 abut against the sides of the square hole 5 of the head chip 3 held by the holding means 11*d*. The press members 368 and the drive cylinder 371 constitute a loosening preventing means 374 which prevents loosening of the wire 4 wound around the head chip 3 by the elastic members 369.

Figure 43:
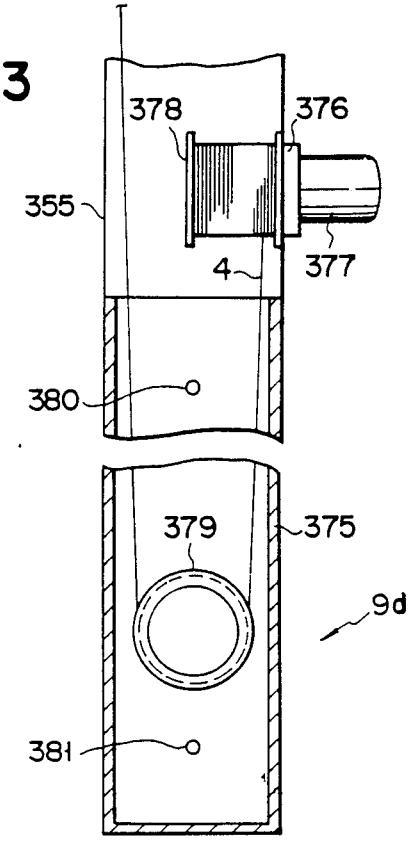

The wire supply unit 12*d* has a structure as shown in FIGS. 43 to 46. A flat box-like case 375 having an open top is fixed to the vertical side surface of the pole 355, as shown in FIG. 43. A mounting member 376 is arranged above the case 375 and on the pole 355. A supply reel 378 driven by a fourth motor 377 is mounted on the mounting member 376. The wire 4 to be wound around the head chip 3 is wound around the supply reel 378. The wire 4 supplied from the supply reel 378 is guided into the case 375, is loosened therein, and is guided therefrom. The loosened portion of the wire 4 in the case 375 is engaged with a weight 379 which is housed in the case and formed into a ring shape from a light material such as Al or a synthetic resin. This weight 379 serves to apply a predetermined tension to the wire 4. A first photosensor 380 is arranged on the upper portion of the case 375, and a second photosensor 381 is arranged on the lower portion thereof. These photosensors 380 and 381 control the rotation of the fourth motor 377. When, the loosening amount of the wire 4 in the case 375 is reduced, the weight 279 is moved upward. When the weight 279 is detected by the first photosensor 380, the supply reel 387 is actuated by the fourth motor 377 in accordance with a detection signal from the photosensor, and the wire 4 is supplied from the supply reel 378. When the wire 4 is supplied from the supply reel 378 and when the weight 379 is moved downward and is detected by the second photosensor 381, the fourth motor 377 is stopped by a detection signal from the second photosensor 381. The loosened wire 4 in the case 375 is thus maintained within a predetermined range by the first and second photosensors 380 and 381.

Figure 44:
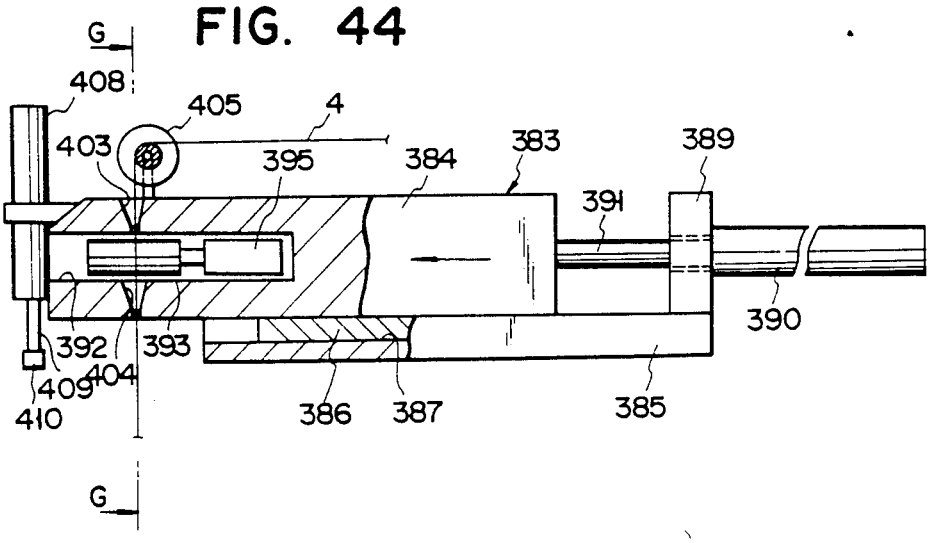
Figure 45:
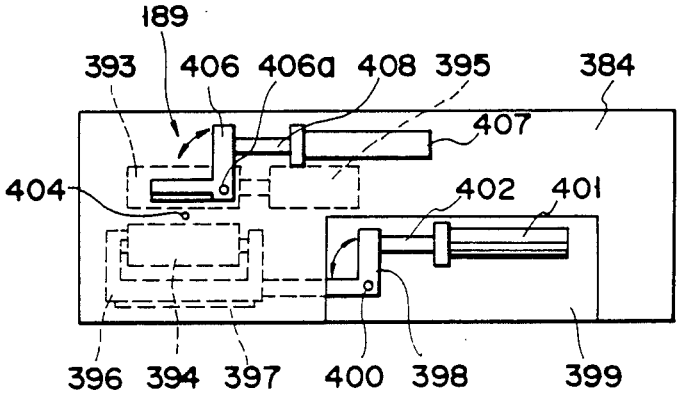
Figure 46:
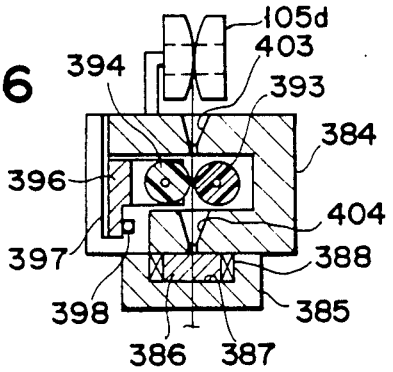
Figure 47:
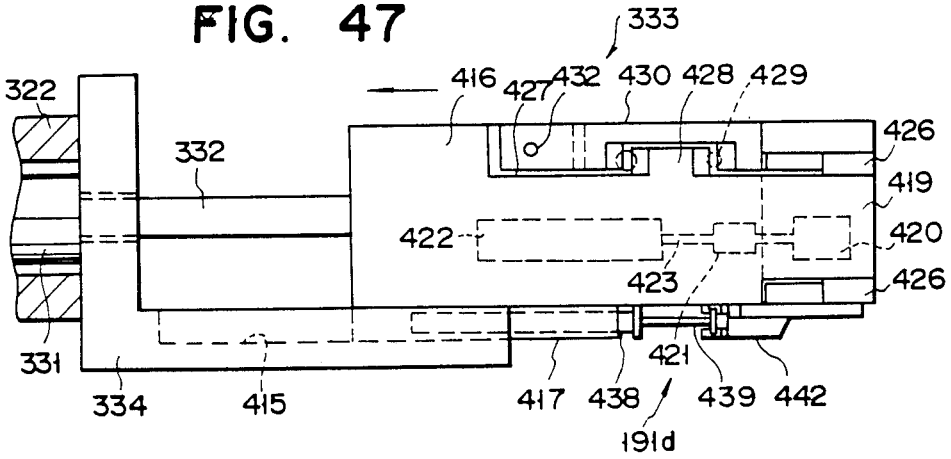
Figure 48:
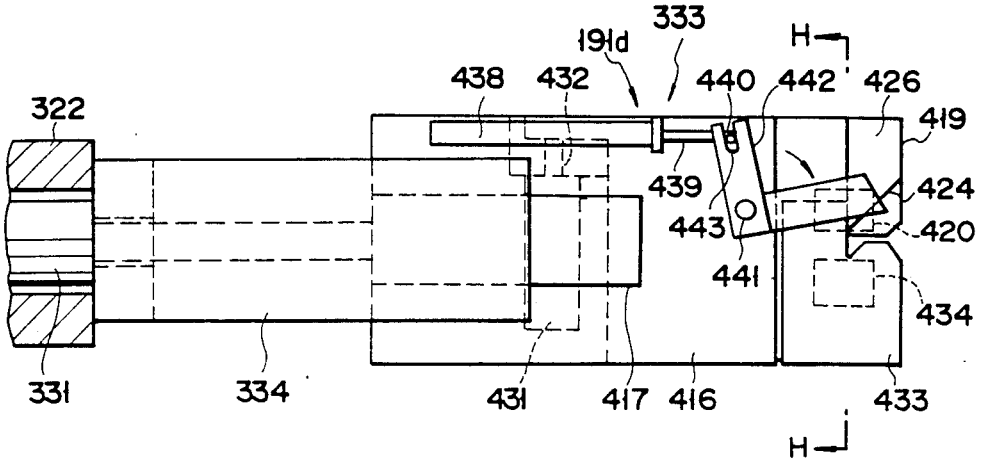

The wire 4 supplied from the case 375 is guided by a guide ring 382 mounted on the pole 355 and is guided to a feeding mechanism 383 arranged above the holding means 11*d*, as shown in FIG. 39. The feeding mechanism 383 together with the case 375 and the supply reel 378 constitute the wire supply unit 12*d*. The feeding mechanism 383 has a main body 384. The main body 384 has a rectangular shape and is slidably mounted on a plate-shaped receiving member 385 arranged above and parallel to a horizontal portion of the pole 355. A projection 386 is formed on the lower surface of the main body 384 to extend longitudinally at the center along the width thereof, as shown in FIGS. 44 and 46. The projection 386 is slidably held through a linear guide 88 in a groove 387 formed in the receiving member 385. A vertical wall 389 stands upright at one end of the receiving member 385. A sixth drive cylinder 390 is fixed to the vertical guide 389 so that its axis is held horizontally. An actuating rod 391 of the sixth drive cylinder 390 is coupled to the rear end of the main body 384. Therefore, the main body 384 is driven forward as indicated by the arrow in FIG. 44 by the sixth drive cylinder 390. A chamber 392 is formed at the distal end of the main body 384, as shown in FIG. 44. A drive roller 393 and a driven roller 394 are horizontally arranged in the chamber 392 such that their axes are aligned with the length of the main body 384. The drive roller 393 is coupled to a fifth motor 395 in the chamber 392 to be driven thereby. The driven roller 394 is rotatably supported by a U-shaped support 396. The support 396 is elastically supported in the chamber 392 by a leaf spring 397, as shown in FIG. 45. One end of an L-shaped lever 398 is fixed to the support 396. An intermediate portion of the lever 398 is pivotally supported by a pivot shaft 400 in a recess 399 formed in the lower surface of the main body 384. An actuating rod 402 of an open/close cylinder 401 in the recess 399 is coupled to the other end of the lever 398. When the open/close cylinder 401 is actuated and the lever 398 is pivoted in the direction indicated by the arrow in FIG. 45, the support 396 is moved horizontally against the biasing force of the leaf spring 397. Since the driven roller 394 is interlocked with the movement of the support 396, the driven roller 394 is displaced either toward or away from the drive roller 393.

First and second guide holes 403 and 404 having a conical shape and which communicate with the chamber 392 are formed above and below the chamber 392 and at the distal end of the main body 384, as shown in FIG. 44. These guide holes 403 and 404 are coaxial and extend along a direction perpendicular to the axes of the rollers 393 and 394. The first guide hole 403 has a smaller diameter toward the chamber 392, while the second guide hole 404 has a smaller diameter toward the lower surface of the main body 384. The wire 4 guided from the case 375 by the guide ring 382 to the feeding mechanism 383 is engaged with a guide roller 405 mounted on the main body 384 near the first guide hole 403, and is then inserted into the first guide hole 403. The wire 4 inserted in the first guide hole 403 is introduced into the second guide hole 404 through a gap between the rollers 393 and 394. Therefore, when the drive roller 393 is driven, because it is in contact with the driven roller 394, the wire 4 is fed from the second guide hole 404. When the sixth drive cylinder 390 is actuated and the the main body 384 is moved forward, the second guide hole 404 is opposite the square hole 5 of the head chip 3 held by the holding means 11.

An intermediate portion of an L-shaped cutter 406 constituting a cutting mechanism 189 is pivotally supported by a pivot shaft 406*a* on the lower surface of the main body 384. One side of the cutter 406 is located adjacent to the second guide hole 404, and an actuating rod 408 of a cutting cylinder 407 is coupled to the other side thereof. Thus, when the cutting cylinder 407 is actuated, the wire 4 fed from the second guide hole 404 is cut.

A press cylinder 408 partially consituting a fixing mechanism is vertically arranged on the distal end of the main body 384. A press member 410 comprising an elastic member is mounted at the distal end of an actuating rod 409 of the press cylinder 408. When the press cylinder 408 is actuated, the press member 410 is urged against the upper surface of the gripper 360 of the holding means 11 and clamps, together with the gripper 360, an end of the wire 4 which has been supplied from the feeding mechanism 383 and cut by the cutter 406.

Figure 49:
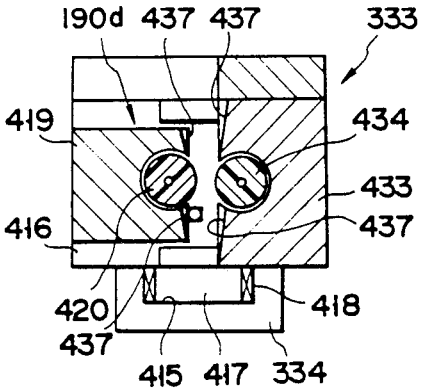
Figure 50:
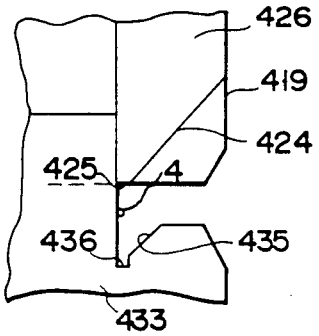
Figure 51:
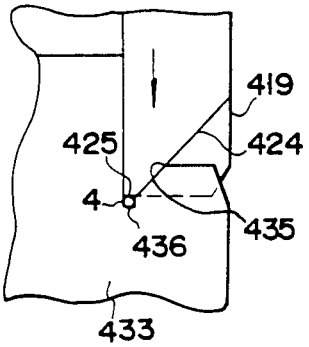

The wire feeding unit 333 has the construction shown in FIGS. 47 to 51. A groove 415 is formed along the length of the upper surface of the horizontal portion of the receiving member 334. A projection 417 formed on the lower surface of a block-like main body 416 of the wire feeding unit 333 is slidably received in the groove 415 through a linear guide 418, as shown in FIG. 49. When the first drive cylinder 331 is actuated, the main body 416 is withdrawn in the direction indicated by the arrow shown in FIG. 47. A drive side feeding roller 420 constituting a feeding mechanism is arranged in the distal end 419 of the main body 416, such that its axis is aligned with the length of the main body 416. The feeding roller 420 is coupled through a coupling 421 to a rotating shaft 423 of a rotating motor 422 housed in the main body 416. A pair of guide members 426 is mounted on the upper and lower surfaces of the distal end 419. The guide members 426 have inclined surfaces 424 at the distal ends thereof, and the extreme ends are chamfered to form flat surfaces 425, as shown in FIG. 50. A recess 427 is formed in the upper surface of the main body 416, and a projection 428 is formed in the recess 427 along the width of the upper surface of the main body 416. A drive body 430 is slidably mounted on the projection 428 through a linear guide 429. An actuating rod 432 of an open/close cylinder 431 arranged along the width of the main body 416 is coupled to one end of the drive body 430. A clamper 433 is mounted on the other end of the drive body 430 such that it is opposite the distal end 419 of the main body and its upper surface is in contact with the drive body 430. The clamper 433 has a substantially U shape. A driven side feeding roller 434 is rotatably arranged in th clamper 433 through a support member (not shown). The support member is elastically held by a leaf spring (not shown). An inclined surface 435 and a groove 436 shaped to correspond to that of the distal end of the guide member 426 are respectively formed at the upper and lower sides of the clamper 433. When the open/close cylinder 431 is actuated, the clamper 433 is driven in a direction toward or away from the distal end 419, that is, in the direction to be closed or opened. When the main body 416 is moved to its second position by the drive cylinder 331 while the clamper 433 is open, the wire 4 supported between the video head 1' held by the holding means 11*d* and the wire suction unit 50 (as will be described later) is inserted into the space between the distal end 419 and the clamper 433, as shown in FIG. 50. When the clamper 433 is driven in the closing direction as indicated by the arrow in FIG. 51 in this state, the inclined surface 424 of the distal end 419 is fitted with the inclined surface 435 of the clamper 433. Then, the wire 4 is positioned in the groove 436 to be slidable therein, and is also clamped between the rollers 420 and 434. When the drive side feeding roller 420 is driven in the direction of the arrow in FIG. 49, the wire 4 is fed in the same direction. Recesses 437 for forming conical guide holes upon the closing of the clamper 433 are formed in the opposite ends of the distal end 419 and the clamper 433 at the two sides of the feeding rollers supported therein. The guide holes formed by these recesses 437 have a smaller diameter in the feeding direction of the wire 4.

A cutting cylinder 438 constituting part of a cutting mechanism 191*d* is mounted on the lower surface of the main body 416 to extend along its length. An engaging pin 440 is arranged at the distal end of an actuating rod 439 of the cutting cylinder 438. The engaging pin 440 is engaged with an engaging groove 443 formed in one side of an L-shaped cutter 442 having an intermediate portion thereof pivotally supported on the lower surface of the main body 416 by a pivot shaft 441. The other side of the cutter 442 having a blade thereon is located above the lower surface of the distal end 419 and near the guide hole. When the cutting cylinder 438 is actuated and the cutter 442 is pivoted in the direction indicated by the arrow shown in FIG. 48, the wire 4, clamped and positioned by the distal end 419 and the clamper 433 and fed from the lower surface of the main body 416, is cut.

Figure 52:
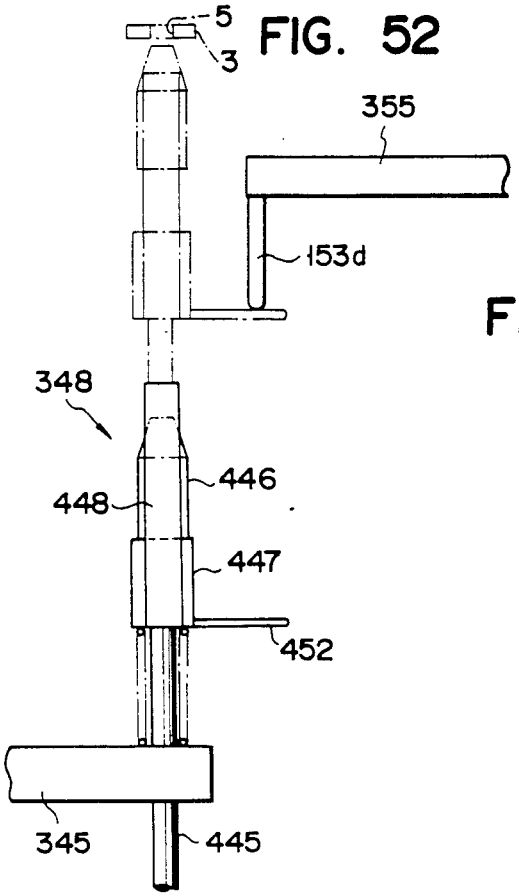
Figure 53:
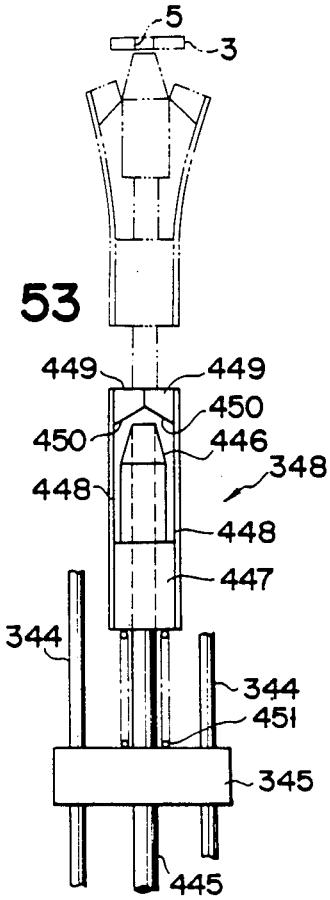

The wire suction unit 348 has the structure shown in FIGS. 52 and 53. A pipe 445 communicating with a vacuum pump 182 on the base 10*d* is mounted on the mounting arm 345 slidably mounted on the guide rods 344. A sleeve 446 is fitted at the distal end of the pipe 445, and the distal end of the sleeve 446 is tapered. A prism-like moving body 447 is slidably mounted on the pipe 445 between the arm 345 and the sleeve 446. Leaf springs 448 is fixed to a pair of opposing side surfaces of the moving body 447. The leaf springs 448 extend from the moving body 447 to be parallel to each other. Elastic members 449, such as rubber members, are mounted on the inner surface of the other end of each of the leaf springs 448 such that they are in contact with each other. The rear end faces of the elastic members 449 which face the sleeve 446 are formed into tapered surfaces 450. A compression spring 451 is hooked between the mounting arm 345 and the moving body 447. A locking piece 452 is arranged on the moving body 447 so as to extend along a direction perpendicular to the axis of the pipe 445. When the wire suction unit 348 is moved upward to its front position adjacent to the head chip 3 held by the holding means 11*d*, as indicated by the broken line in FIGS. 52 and 53, the locking piece 452 abuts against a stopper 453 extending downward from the distal end lower surface of the horizontal portion of the pole 355. Then, since the movement of the moving body 447 is prevented and since only the pipe 445 is moved upward, the sleeve 446 moves the pair of leaf springs 448 apart from each other, and occupies and projects from the space therebetween. At this time, the distal end of the sleeve 446 is coaxially opposite to the square hole 5 of the head chip 3 held by the holding means 11*d*.

As shown in FIGS. 40 and 41, a pair of blowing pipes 455 is vertically arranged on the base 10*d* to be parallel to each other at the sides of the holding means 11*d*. The blowing pipes 455 as blowing means 180*a* communicate with a compressed air supply source (not shown). A number of nozzles 456 are formed along the axial direction on the wall of the blowing pipes 455 at predetermined intervals. Compressed air is horizontally blown from the nozzles 456 to blow the wire 4 which may be loosened between the head chip 3 and the wire feeding unit 333, thereby preventing any entanglement and twisting of the wire 4.

Figure 54A:
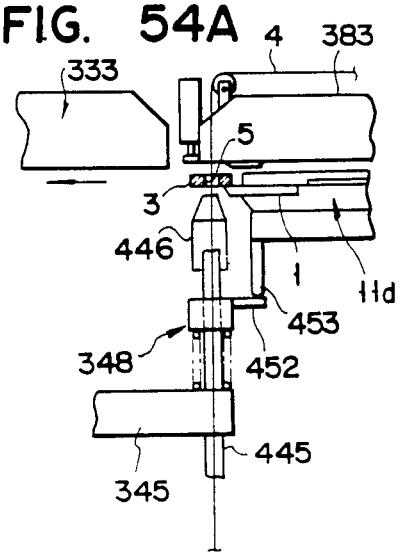
Figure 54B:
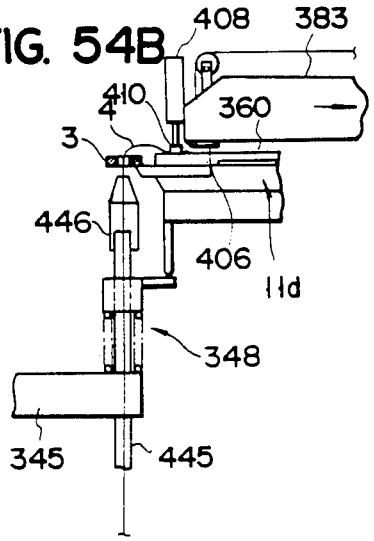

The operation of the winding apparatus 6*d* having the above structure will be described with reference to FIGS. 54A to 54F. First, as shown in FIG. 54A, the wire feeding unit 333 is withdrawn to its first position. The feeding mechanism 383 of the wire supply unit 12*d* is moved in the forward direction to make the distal end of the mechanism 383 opposite the upper surface of the head chip 3. At the same time, the wire suction unit 348 is moved to the first position below the head chip 3, and moved to the front position adjacent to the head chip 3 so as to make the distal end of the sleeve 446 coaxially opposite the lower end of the square hole 5 of the head chip 3. The feeding mechanism 383 of the wire supply unit 12*d* is actuated to supply the wire in this state, and the wire suction unit 348 is actuated so as to draw by suction the wire 4 supplied from the feeding mechanism 383 through the square hole 5. When the length of the wire 4 reaches the length needed to be wound around the head chip 3, the feeding mechanism 383 is withdrawn in the direction indicated by the arrow shown in FIG. 54B. The press cylinder 408 mounted at the distal end of the feeding mechanism 383 is actuated, and the trailing end of the wire 4 is clamped by the press member 410 and by the upper surface of the gripper 360 of the holding means 11*d*. Thereafter, the cutter 406 of the wire supply unit 12*d* is actuated to cut the wire 4.

Figure 54C:
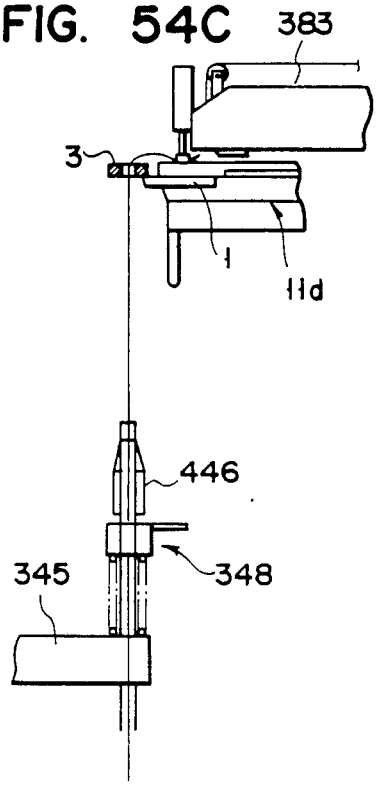
Figure 54D:
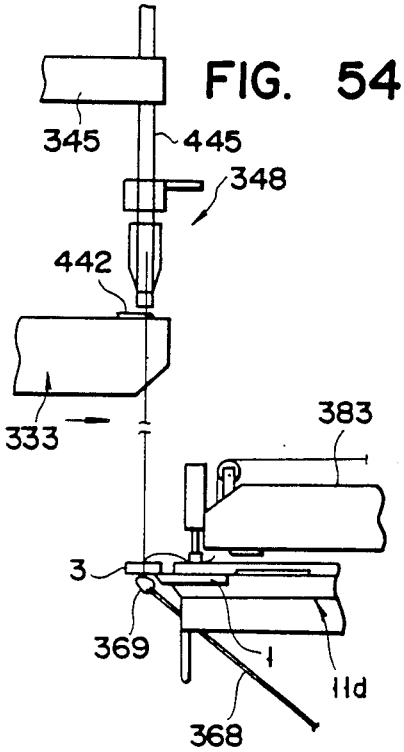

Then, the second drive cylinder 346, which has the actuating rod 347 coupled to the mounting arm 345 supporting the wire suction unit 348, is actuated so as to move the wire suction unit 348 down to the rear position shown in FIG. 54C. The wire 4 drawn by suction into the pipe 445 of the wire suction unit 348 is elastically clamped by the elastic members 449 of the wire suction unit 348. Therefore, the wire 4 is guided from the pipe 445 as the wire suction unit is moved downward, and an end is clamped by the elastic members 449. Then, the wire 4 is suspended between the head chip 3 and the wire suction unit 348. The third motor 340 is energized to rotate the second gear 339 which is interlocked with the first gear 336 and hence the cylinder 337. Thus, the cylinder 337 is rotated by 180°, and the wire suction unit 348 is moved to its second position at which it is located directly above the head chip 3, as shown in FIG. 54D.

Subsequently, the screw shaaft 315 is driven to move the movable body 319 away from the head, that is, to the rear position, and to stop it at a predetermined position. At the same time, the fifth drive cylinder 371 is actuated to pivot the press member 368, and the elastic members 369 arranged at its end abut against the head chip 3. The wire 4 wound a half turn around the head chip 3 is thus pressed and can not be loosened.

The wire 4 is wound by a half turn at one side of the square hole 5 of the head chip 3 and is suspended between the head chip 3 and the wire suction unit 348. Then, the wire feeding unit 333 is driven by the second motor 326. The lower surface of the unit 333 having the cutter 442 thereon is turned upward, and the clamper 433 is opened by the open/close cylinder 431. The first drive cylinder 331 is driven in this state to move the wire feeding unit 333 to its second position, and thereafter the clamper 433 is driven in the closing direction, so that the drive and driven side feeding rollers 420 and 434 clamp the leading end portion of the wire 4, that is, the end portion at the side of the unit 348. After the wire 4 is thus clamped, the cutter 442 is actuated, and the wire 4 is cut at a position between the units 348 and 333.

Figure 54E:
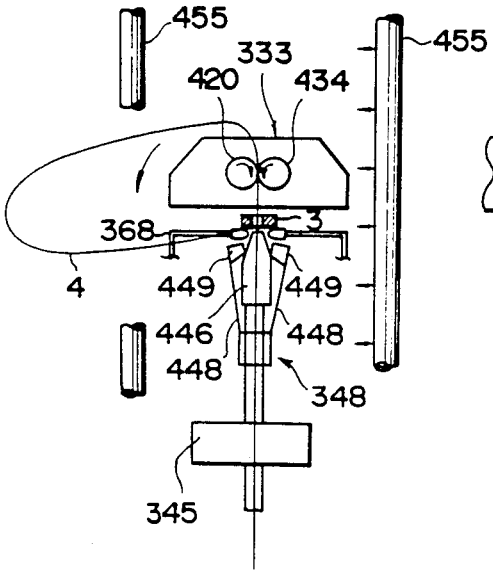

Then, as shown in FIG. 54E, the wire feeding unit 333 is moved to its front position adjacent to and above the head chip 3 and is also rotated by 180° in the direction indicated by the arrow. The third motor 340 is actuated to rotate the wire suction unit 348 by 180° to return it to the first position below the head chip 3. At this time, compressed air is blown from the blowing pipe 455 at the right side of the head chip 3 shown in FIG. 54E. This blown air blows the wire 4 loosened upon the downward movement of the wire feeding unit 333 so that entangling and twisting of the wire 4 is prevented. Then, the wire suction unit 348 is moved to the front position by the second drive cylinder 346. The distal end of the sleeve 446 is opposite the lower end of the square hole 5 of the head chip 3, and a suction force is generated in the wire suction unit 348. Thereafter, the drive side feeding roller 420 of the wire feeding unit 333 is driven to feed the wire 4, and the wire 4 is thus drawn by suction to the wire suction unit 348 through the square hole 5 of the head chip 3.

Figure 54F:
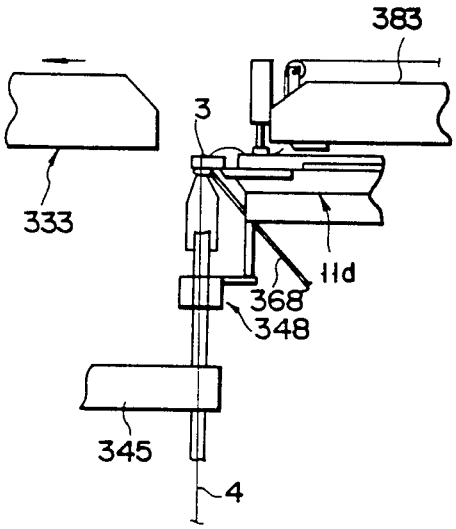

When a predetermined length of the wire 4 is drawn by suction to the wire suction unit 348, the clamper 433 of the wire feeding unit 333 is opened, and the first drive cylinder 331 is actuated to withdraw the wire feeding unit 333 to the first position, as shown in FIG. 54F. Then, the loosened portion of the wire 4 is drawn by suction to the wire suction unit 348, so that one turn of the wire 4 is wound around one side of the square hole 4 of the head chip 3.

When the wire 4 is wound by one turn around the head chip 3, each of the units is operated from the state shown in FIG. 54F to that shown in FIG. 54C. The above-described cycle is repeated, and the wire 4 is wound around the head chip 3 for a predetermined number of turns. After the wire 4 is wound around one side of the square hole 5 of the head chip 3 by a predetermined number of turns, the wire 4 is then wound around the other side of the square hole 5 in a similar manner. In this case, in the step from FIG. 54C to FIG. 54F, the wire suction unit 348 is rotated by 180° in the opposite direction to that described above, and the compressed air is blown from the blowing pipe 455 at the left side, as shown in FIG. 54E.

In the fourth embodiment, as in the former embodiments, the wire 4 can be automatically wound around the head chip 3. As in the case of the first embodiment, in the fourth embodiment, drive sources such as cylinders or motors for driving the various unis and members are controlled by the control section 196 (FIG. 22).

FIGS. 55 to 57G show the fifth embodiment of the present invention. The fifth embodiment is different from the fourth embodiment in that the apparatus of the fifth embodiment has a pair of wire feeding units 112*e* and 113*e* and does not have a wire suction unit. The same reference numerals as those of the fourth embodiment denote the same parts in FIGS. 55 to 57G.

Figure 55:
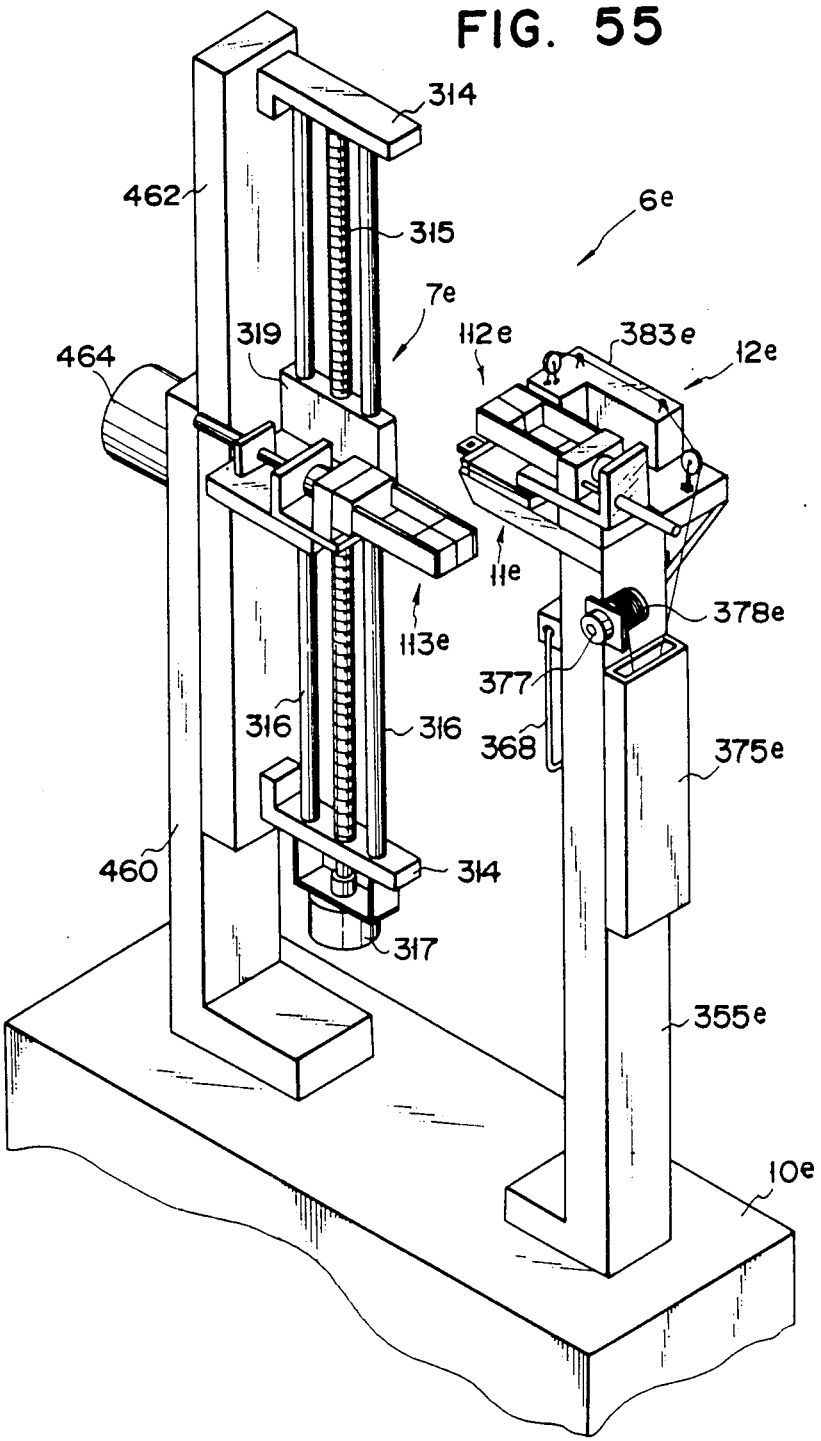
Figure 56:
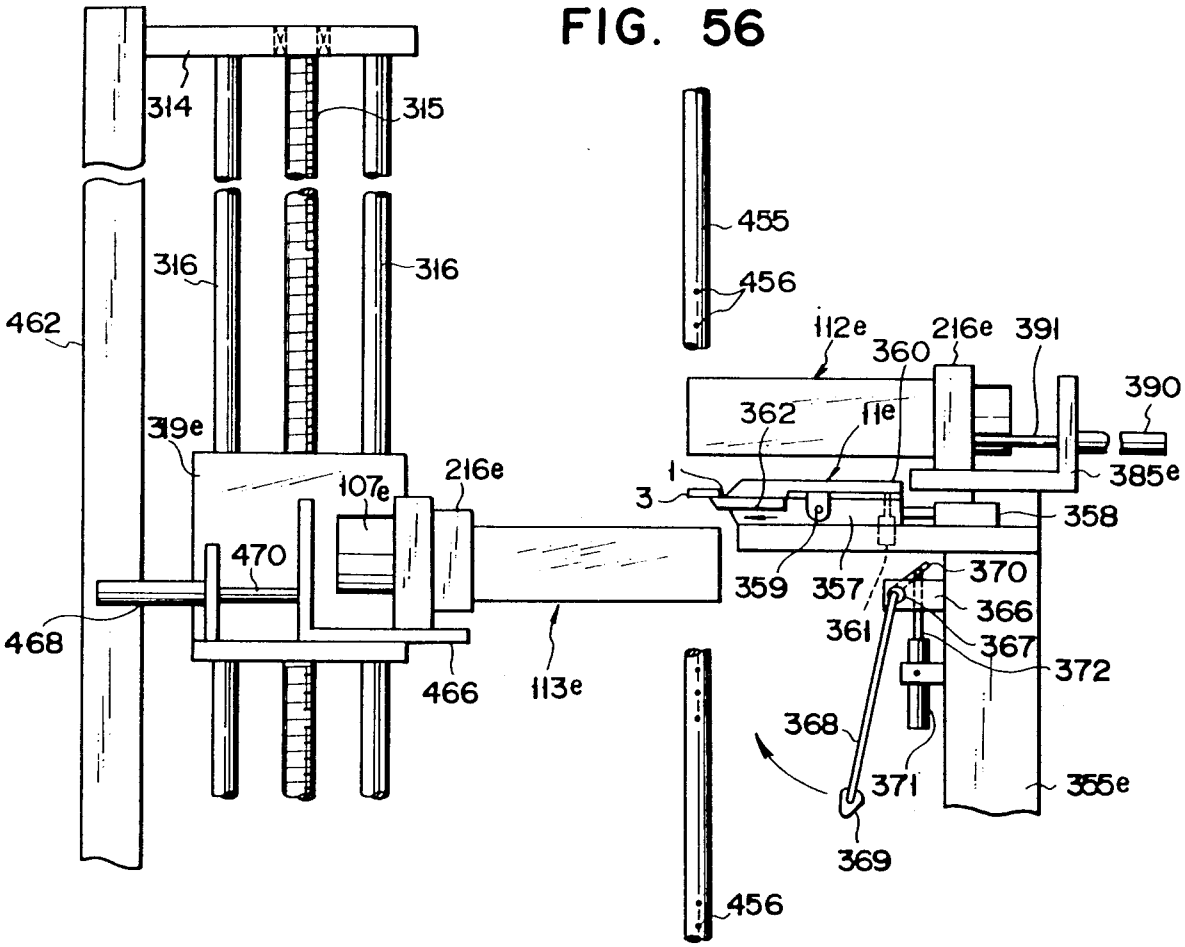

As shown in FIGS. 55 and 56, an L-shaped pole 355*e* and a pole 460 stand upright on the upper surface of a base 10*e* and are parallel to each other. A holding means 11*e* holding a video head 1 is arranged on the upper surface of the horizontal portion of the pole 355*e*. A first wire feeding unit 112*e* is arranged above the holding means 11*e*. The wire feeding unit 112*e* has the same structure as that of the third embodiment; it has a pair of blocks and an open/close mechanism 216*e* for opening or closing the blocks. The wire feeding unit 112*e* is slidably arranged on a receiving member 385*e* on the upper surface of the horizontal portion of the pole 355*e*. The unit 112*e* is driven by a drive cylinder 390 toward or away from the video head 1. A wire supply unit 12*e* of the same structure as that of the fourth embodiment is arranged on the pole 355*e*. However, in the fifth embodiment, a feeding mechanism 383*e* is movable in a direction parallel to the moving direction of the first wire feeding unit 112*e* and is also movable in the direction perpendicular to the parallel direction with respect to the video head 1.

An intermediate portion of a pivot arm 462 is rotatably supported on the pole 460 so as to extend parallel thereto. The pivot arm 462 is driven by a motor 464 mounted on the pole 460. Support members 314 are fixed on the two ends of the pivot arm 462, respectively, and extend toward the pole 355*e* and parallel to each other. A screw shaft 315 extends rotatably between the support members 314. A pair of guide rods 316 extend parallel to each other between the support members 314 and at the two sides of the screw shaft 315. The screw shaft 315 and guide rods 316 extend parallel to the pivot arm 462. A motor 317 for driving the screw shaft 315 is coupled to its lower end. An L-shaped movable body 319*e* is mounted on the screw shaft 315 and the guide rods 316. When the screw shaft 315 is driven, the movable body 319*e* is moved along the guide rods 316. A receiving member 466 is arranged on the upper surface of the horizontal portion of the movable body 319*e* so as to be slidable along a direction perpendicular to the moving direction of the movable body 319*e*. A drive rod 470 of a drive cylinder 468 mounted on the movable body 319*e* is coupled to the receiving member 466. The second wire feeding unit 113*e* is mounted on the receiving member 466. As in the first wire feeding unit 112*e*, the second wire feeding unit 113*e* has a pair of blocks, an open/close mechanism 216*e*, and a motor 107*e* for rotating these blocks. When the drive cylinder 468 is actuated to drive the receiving member 319*e*, the second feeding unit 113*e* is moved toward or away from the video head 1 held by the holding means 11*e*. When the movable body 319*e* is driven by the motor 317, the unit 113*e* is moved along the guide rods 316 between a front position adjacent to the video head 1 and a rear position separate from the video head. When a pivot arm 462 is pivoted by the motor 464, the second wire feeding unit 113*e* is moved between a first position and a second position below and above the video head 1. These drive sources such as the motors and drive cylinders are controlled by a control section 196 (FIG. 22) as in the case of the first embodiment.

The operation of the winding apparatus 6 having the above structure will be described below.

Figure 57A:
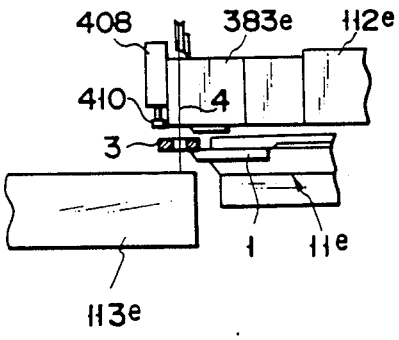
Figure 57B:
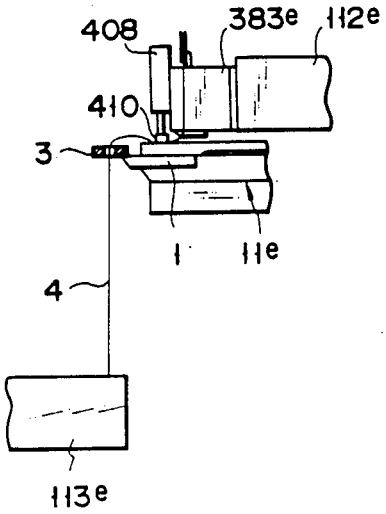

First, as shown in FIG. 57A, after the video head 1 is held by the holding means 11*e*, the first wire feeding unit 112*e* is withdrawn. At the same time, the feeding mechanism 383*e* of the wire supply unit 12*e* is moved toward the wire feeding unit 112*e* so as to be opposite its distal end toward the head chip 3 of the video head 1. At the same time, the second wire feeding unit 113*e* is moved to the front position and the first position to be opposite the lower end of a square hole 5 of the head chip 3. At this time, a pair of guide holes 268 and 269 (FIG. 33) of the wire feeding unit 113*e* is coaxially positioned with the square hole 5. The feeding mechanism 383 is actuated in this state to feed the wire 4 through the square hole 5 and to supply it into the guide hole 268 of the wire feeding unit 113*e*. At the same time, feed rollers 223 (FIG. 33) of the wire feeding unit 113*e* are driven to feed the wire 4 downward. When the lower end, or the leading end, of the wire 4 reaches the lower guide hole 269 of the wire feeding unit 113*e*, the feeding mechanism 383*e* and the feed rollers 223 are stopped. Then, as shown in FIG. 57B, the second wire feeding unit 113*e* is moved downward to the rear position to pull a predetermined length of the wire 4, and the feeding mechanism 383*e* is withdrawn. After the end of the wire 4 at the side of the feeding mechanism 383*e* is clamped onto the upper surface of the holding means 11*e* by the press member 410, the wire 4 is cut by a cutter of the feeding mechanism.

Figure 57C:
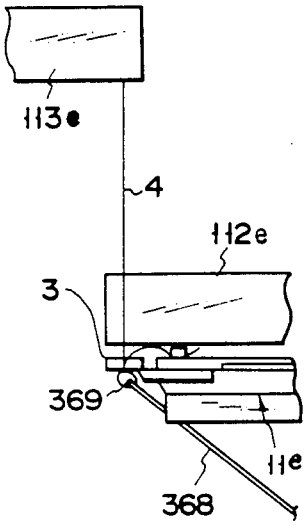
Figure 57D:
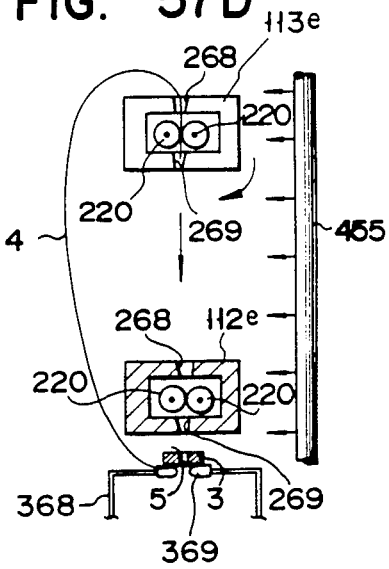
Figure 57E:
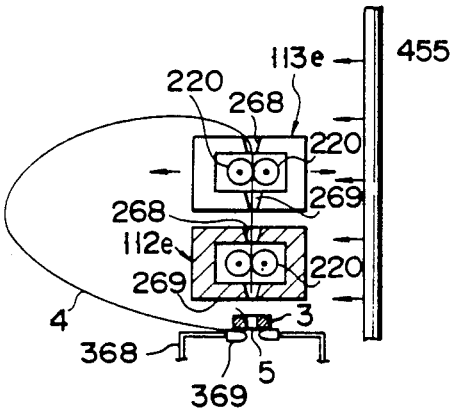
Figure 57F:
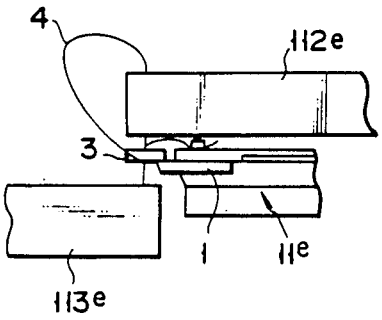
Figure 57G:
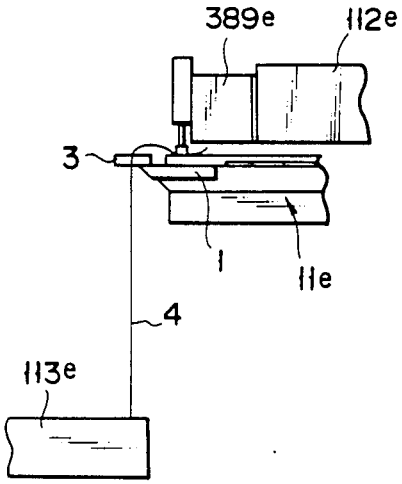

Subsequently, as shown in FIG. 57C, the first wire feeding unit 112*e* is moved to be opposite the upper surface of the head chip 3. At this time, the guide holes 268 and 269 of the wire feeding unit 112*e* are coaxial with the square hole 5. Then, the motor 464 is driven to pivot the pivot arm 462 by 180° so as to position the second wire feeding unit 113*e* at a position above the head chip 3, that is, at its second position. The drive cylinder 371 is driven to pivot press members 368 in a direction toward the head chip 3, and the wire 4 which is wound by a half turn around the head chip 3 is pressed by elastic members 369. As shown in FIG. 57D, the second wire feeding unit 113*e* is moved downward to its front position. During this movement, the wire feeding unit 113*e* is pivoted clockwise by 180° so as to direct the leading end of the wire 4 toward the head chip 3. Subsequently, as shown in FIG. 57E, the feed rollers 223 of the first and second wire feeding unis 112*e* and 113*e* are driven to feed the wire 4 from the second wire feeding unit to the guide hole 268 of the first wire feeding unit. When the leading end of the wire 4 reaches the guide hole 269 of the first wire feeding unit 112*e*, the feed rollers 223 are stopped. After the second wire feeding unit 113*e* is opened by the open/close mechanism 216*e*, it is removed from the wire 4. Then, as shown in FIG. 57F, the wire feeding unit 113*e* is moved to the first position and the front position, that is, at a position below the head chip 3. During this time, the second wire feeding unit 113*e* is pivoted by the motor 107 by 180° such that the guide hole 268 is located thereabove. The feed rollers 223 of the first and second wire feeding units 112*e* and 113*e* are driven to feed the wire 4 from the first wire feeding unit through the square hole 4 of the head chip 3 and feed it to the guide hole 268 of the second wire feeding unit. When the leading end of the wire 4 reaches the lower guide hole 269 of the second wire feeding unit 113*e*, the respective feed rollers 223 are stopped. After the first wire feeding unit 112*e* is opened by the open/close mechanism 216*e*, it is withdrawn and is removed from the wire 4. Thereafter, the second wire feeding unit 113*e* is moved downward to its rear position. Then, the wire 4 is suspended between the head chip 3 and the wire feeding unit 113*e*, and the wire 4 is wound by one turn around one side of the square hole 5 of the head chip 3. In the steps shown in FIGS. 57D to 57G, the loosened wire 4 is blown by compressed air supplied from a blowing pipe 455 arranged to the right of the head chip 3. Therefore, entanglement or twisting of the wire 4 can be prevented.

After the wire 4 is wound around the head chip by one turn, the steps shown in FIGS. 57C to 57G are repeated to wind the wire 4 by a predetermined number of turns.

In the winding apparatus according to the fifth embodiment of the present invention, as in the case of the former embodiments, the wire 4 can be automatically wound around the head chip 3. In the fifth embodiment, the feeding units as shown in FIG. 26 or 36 may be used as the first and second wire feeding units.

What is claimed is:

1. An apparatus for winding a wire on an object having a through hole by passing the wire through the through hole, comprising:

a base;

holding means, arranged on the base, for holding the object;

wire supply means for supplying the wire through the through hole from one end of the through hole of the object held by the holding means;

first wire feeding means, arranged at said one end side of the through hole of the object held by the holding means, for clamping the wire and for feeding the clamped wire through the through hole from said one end thereof;

first means for moving the wire feeding means toward and away from the holding means;

second wire feeding means for clamping at the other end side of the through hole the wire supplied through the through hole from said one end thereof and for feeding the clamped wire to the through hole from said one end side thereof;

second means for moving the second feeding means between a first position at the other end side of the through hole and a second position at said one end side of the through hole and between a front position adjacent to the object and a rear position separated from the object, means for rotating said second wire feeding means about an axis perpendicular to the axis of the through hole; and drive means for causing the supply means to supply the wire from said one end of the through hole, causing the second moving means to move the second wire feeding means to the first position at the other end side of the through hole and to the front position thereof, and driving the second wire feeding means to clamp a leading end of the wire supplied;

causing the second moving means to move the second wire feeding means to the rear position thereof so as to suspend the wire between the object and the second wire feeding means, causing the first moving means to move the first wire feeding means to a position in the vicinity of the object, and causing the second moving means to move the second wire feeding means to the second position thereof so as to wind the wire around the object;

causing the rotating means to pivot the second wire feeding means to direct the leading end of the wire toward the object and causing the second moving means to move the second wire feeding means to the front position thereof in the vicinity of the first wire feeding means;

causing the second wire feeding means to feed the wire and clamping the leading end of the fed wire by the first wire feeding means;

causing the second moving means to move the second wire feeding means to the first position and the front position thereof, thereafter causing the first feeding means to feed the wire through the through hole from said one end thereof, causing the second wire feeding means to clamp the fed wire at the other end of the through hole, causing the first moving means to move the first wire feeding means away from the object, and causing the second moving means to move the second wire feeding means to the rear position thereof to wind the wire around the object; and thereafter continuously operating the apparatus in the above sequential steps.

2. An apparatus according to claim 1, wherein said holding means includes a column standing upright on the base, a holding portion formed on the column to hold thereon the object, and fixing means for fixing the object in the holding portion.

3. An apparatus according to claim 2, wherein said first wire feeding means is arranged on the column and in the vicinity of the holding means to be movable by said first moving means along a direction perpendicular to the axis of the through hole of the object held by the holding means.

4. A winding apparatus according to claim 3, which further comprises: a guide mechanism for guiding movement of the second wire feeding, the guide mechanism including a pole standing upright on the base, a pivot arm which is supported by the pole to be pivotal by said rotating means around the axis perpendicular to the axis of the through hole of the object and extends to two sides of the object and parallel to the axis of the through hole, a pair of guide rods mounted on the pivot arm and extend parallel to the pivot arm from one end to the other end of the pivot arm, and a movable body supported by the guide rods to be movable thereon by said second moving means and supporting thereon the second wire feeding means.

5. A winding apparatus according to claim 4, wherein said second moving means includes a screw shaft which is mounted on the pivot arm, extends parallel to the guide rods from the one end to the other end of the pivot arm, and engages with the movable body; a first drive source which is coupled to one end of the screw shaft to drive the screw shaft, thereby moving the movable body along the guide rods; and said rotating means includes a second drive source, mounted on the pole and coupled to the pivot arm, for pivoting the pivot arm.

6. An apparatus according to claim 4, wherein each of said first and second wire feeding means includes a pair of arms extending toward the holding means to be parallel to each other in a direction perpendicular to the first and second guide rods rails; a clamping mechanism, disposed at extending end portions of the arms, for clamping the leading end of the wire supplied thereto; and a feed mechanism for feeding the wire clamped by the clamping mechanism toward the holding means.

7. An apparatus according to claim 6, wherein each of said clamping mechanisms includes a pair of blocks mounted on each of the extended end portions of each of the arms so as to oppose each other, each of the blocks having a closing surface; and an open/close mechanism, mounted on a corresponding one of the sliders, for opening/closing the arms between an open position where the closing surfaces of the blocks are separated from each other and a closed position where the closing surfaces are brought into contact with each other along a direction perpendicular to the first and second guide rods.

8. An apparatus according to claim 7, wherein each of said blocks has a recess formed in the closing surface, and each of the feed mechanisms includes a pair of feed rollers disposed in the recess so as to clamp the wire when the blocks are located in the closed positions.

9. An apparatus according to claim 8, wherein said first moving means includes a first drive source for rotating the first wire feeding means about an axis perpendicular to the first and second guide rods; said rotating means includes a second drive source for rotating the second wire feeding means about the axis perpendicular to the first and second guide rods; and said drive means includes a third drive source for driving the feed rollers of each of the first and second wire feeding means.

10. An apparatus according to claim 7, wherein each of said blocks has first and second guide grooves formed in the closing surface thereof, and the first and second guide grooves of one of the blocks constitute together with the first and second grooves of the other block first and second guide holes for positioning the wire when the blocks are located in the closed position.

11. An apparatus according to claim 10, wherein said first and second guide holes are formed coaxially with the through hole of the object held by the holding means and have a conical shape tapered in the feed direction of the wire.

12. An apparatus according to claim 11, wherein said first and second guide grooves formed in each of the blocks respectively have a shape corresponding to a half of a cone when the cone is divided into halves along an axis thereof.

13. An apparatus according to claim 10, wherein said first and second guide grooves in one block of each of the clamping mechanisms respectively have a shape corresponding to a half of a cone when the cone is divided into halves along an axis thereof, the first and second guide grooves in the other block have similar shapes and smaller sizes than those of the first and second guide grooves of said one block, the first and second grooves of said one block and said other block being tapered in the feed direction of the wire, and the first and second guide grooves in said other block having vertices located within the first and second guide grooves of said one block, respectively.

14. An apparatus according to claim 2, wherein said holding means includes press means for preventing the wire wound around the object from being loosened.

15. An apparatus according to claim 14, wherein said press means includes a pair of rod-like press members each having one end pivotally supported by the column, and an elastic member, mounted at the other end of each of the press members, for pressing the wire wound around the object in such a manner that the elastic members are brought into contact with the object when the press members are pivoted, the drive means including a first drive source for pivoting the press members.

16. An apparatus according to claim 2, wherein said wire supply means includes a supply reel on which the wire is wound, a feed mechanism for feeding the wire from the supply reel to the object, and adjusting means for adjusting a length of the wire to be fed from the supply reel.

17. An apparatus according to claim 16, wherein said supply reel is supported on the column, the feed mechanism has a main body arranged on the column to be movable toward or away from the object, and the drive means includes a second drive source for rotating the supply reel and a third drive source for moving the main body.

18. An apparatus according to claim 17, wherein said feed mechanism includes a driving roller rotatably mounted in the main body, a driven roller arranged in the main body to be parallel to the driving roller and movable toward or away from the driving roller, the driven roller clamping the wire together with the driving roller, a first guide hole formed in the main body to guide the wire fed from the supply reel to a position between the driving and driven rollers, and a second guide hole formed in the main body to guide the wire passing between the driving and driven rollers toward the through hole in the object, the drive means including a fourth drive source for rotating the driving roller to feed the wire.

19. An apparatus according to claim 18, wherein said wire supply means includes a cutting mechanism, mounted on the main body in the vicinity of the second guide hole, for cutting the wire in the vicinity of the second guide hole after a predetermined length of the wire is fed, and the drive means includes a fifth drive source for driving the cutting mechanism.

20. An apparatus according to claim 19, wherein said first and second guide holes are formed coaxially with each other and have axes parallel to the axis of the through hole of the object held by the holding means.

21. An apparatus according to claim 17, wherein said adjusting means includes a case which is mounted on the column and houses therein a portion of the wire which is located between the supply reel and the feed mechanism, a weight movable within the case in accordance with the length of the wire to be fed from the supply reel, and a sensor, arranged inside the case, for detecting movement of the weight and driving the second drive source.

22. An apparatus according to claim 17, wherein said wire supply means includes a fixing mechanism, supported by the main body, for fixing at one side of the object the end of the wire which is located at the side of the wire supply means, the wire being supplied from the supply means through the through hole of the object.

23. An apparatus according to claim 5, which further comprises blow means for blowing air to the wire during operation so as to prevent the wire from being entangled.

24. An apparatus according to claim 23, wherein said blow means includes a pair of blow pipes disposed on the base along the axis of the through hole of the object held by the holding means; and a number of nozzles, formed in the blow pipes along an axial direction thereof to be spaced apart from each other, for blowing air toward the wire located between the holding means and the wire suction means.

* * * * *